US008138676B2

(12) United States Patent
Mills

(10) Patent No.: US 8,138,676 B2
(45) Date of Patent: Mar. 20, 2012

(54) METHODS AND SYSTEMS FOR DIMMABLE FLUORESCENT LIGHTING USING MULTIPLE FREQUENCIES

(76) Inventor: Robert L. Mills, North Vancouver (CA)

( * ) Notice: Subject to any disclaimer, the term of this patent is extended or adjusted under 35 U.S.C. 154(b) by 664 days.

(21) Appl. No.: 12/325,837

(22) Filed: Dec. 1, 2008

(65) Prior Publication Data

US 2010/0134023 A1 Jun. 3, 2010

(51) Int. Cl.
*H01J 13/46* (2006.01)

(52) U.S. Cl. ..... 315/49; 315/46; 315/107; 315/64; 315/94

(58) Field of Classification Search ..... 315/46–54, 315/64–75, 94–107
See application file for complete search history.

(56) References Cited

U.S. PATENT DOCUMENTS

| | | | |
|---|---|---|---|
| 4,215,292 | A | 7/1980 | Inui et al. |
| 4,253,043 | A | 2/1981 | Chermin et al. |
| 4,746,841 | A | 5/1988 | Ogawa |
| 4,949,015 | A | 8/1990 | Nilssen |
| 4,988,920 | A | 1/1991 | Hoeksma |
| 5,128,592 | A | 7/1992 | Dean et al. |
| 5,150,018 | A | 9/1992 | Bruning et al. |
| 5,338,110 | A | 8/1994 | Byun |
| 5,367,223 | A | 11/1994 | Eccher |
| 5,444,333 | A | 8/1995 | Lau |
| 5,483,125 | A | 1/1996 | Kachmarik et al. |
| 5,506,715 | A | 4/1996 | Zhu |
| 5,583,399 | A | 12/1996 | Rudolph |
| 5,825,137 | A | 10/1998 | Titus |
| 5,933,340 | A | 8/1999 | Adamson |
| 6,008,587 | A | 12/1999 | Mills |
| 6,072,282 | A | 6/2000 | Adamson |
| 6,075,326 | A | 6/2000 | Nostwick |
| 6,088,249 | A | 7/2000 | Adamson |
| 6,094,017 | A | 7/2000 | Adamson |
| 6,181,066 | B1 | 1/2001 | Adamson |
| 6,222,325 | B1 | 4/2001 | Wuidart et al. |
| 6,339,299 | B1 | 1/2002 | Wu et al. |
| 6,472,876 | B1 | 10/2002 | Notohamiprodjo et al. |
| 6,639,369 | B2 | 10/2003 | Ribarich |
| 2003/0160579 | A1 | 8/2003 | Amith et al. |
| 2003/0222593 | A1 | 12/2003 | Yamamoto |

FOREIGN PATENT DOCUMENTS

| | | |
|---|---|---|
| EP | 0650313 | 4/1995 |
| EP | 1078557 | 2/2001 |
| EP | 1379122 | 12/2004 |
| WO | 9711580 | 3/1997 |
| WO | 9955125 | 10/1999 |
| WO | 03102994 | 12/2003 |
| WO | 2006056143 | 6/2006 |

*Primary Examiner* — Tuyet Thi Vo
(74) *Attorney, Agent, or Firm* — Oyen Wiggs Green & Mutala LLP

(57) ABSTRACT

A system for operating a fluorescent light is provided. The system comprises: a fluorescent lamp with at least one electrode having at least one corresponding heating filament; a filament signal power supply for providing a filament current signal having a filament current frequency, the filament signal power supply connected to create a filament current through the at least one filament; and a plasma signal power supply for providing a plasma power signal having a plasma power frequency, the plasma signal power supply connected to create a plasma current between the at least one electrode and a gas contained in the fluorescent lamp. The plasma power frequency is greater than the filament current frequency.

26 Claims, 12 Drawing Sheets

METHODS AND SYSTEMS FOR DIMMABLE FLUORESCENT LIGHTING USING MULTIPLE FREQUENCIES

TECHNICAL FIELD

The invention pertains to fluorescent lamps. Particular embodiments of the invention provide methods and systems for providing dimmable fluorescent lamps and their support electronics (ballasts).

BACKGROUND

Fluorescent lamps are efficient light sources. Fluorescent lamps have a wide variety of domestic and industrial applications, including lighting rooms, work spaces and signs, for example. In general, fluorescent light fixtures comprise one or more fluorescent lamps, each lamp providing a separate light source. Fluorescent lamps can vary in size, with larger lamps generally drawing more power and providing more light.

Fluorescent lamps are a gas discharge type of light source. A typical prior art fluorescent lamp 10 is shown in FIG. 1, along with its ballast 12, its power supply 14 and its starter switch 20. Lamp 10 also contains a small amount of mercury (initially in a substantially liquid or amalgam form) and one or more inert gases, usually argon, which are under low pressure (e.g. a 1-5 torr). Ballast 12 conventionally comprises a ferromagnetic inductor 13. Fluorescent lamp 10 comprises a pair of electrodes 16, 18. Electrodes 16, 18 can act as anodes (positively charged) or cathodes (negatively charged). When electrodes 16, 18 act as cathodes, they can introduce electrons into the low pressure gas of lamp 10. The cathodes are typically heated to promote thermionic emission of electrons. For this reason, electrodes 16, 18 typically comprise filaments 16A, 18A which are coated with thermionic emission materials and which are capable of being heated to thermionic emission temperatures. Typical filaments 16A, 18A require heating power on the order of 0.5-5 Watts.

For lamp 10 to create light, there must be current flow or "arc" through lamp 10 (i.e. between electrodes 16, 18). Creating a current arc through lamp 10 typically involves providing a relatively large "ignition voltage" between electrodes 16, 18. The ignition voltage induces ionization of the inert gas in lamp 10 and initiates current flow between electrodes 16, 18. The required ignition voltage for a given lamp 10 depends on many factors. Typical commercial fluorescent lamps of the "hot cathode" type operate with an ignition voltage in a range between 150V-800V AC RMS. Preheating of filaments 16A, 18A tends to reduce the required ignition voltage. Typically, the ignition voltage is provided between electrodes 16, 18 by ballast 12, which works together with starter switch 20 as explained briefly below.

During preheating, starter switch 20 is closed and AC preheat current flows through inductive ballast 12, filament 16A, switch 20 and filament 18A. Typically, this preheat current is at the same frequency as that of the ignition signal and the operating signal, which may be 60 Hz, for example. The preheat current heats filaments 16A, 18A, resulting in the emission of electrons. The preheat current also induces a magnetic field in inductor 13 of ballast 12. During preheating, there may be some ionization of the gas in lamp 10; however, during preheating, the voltage across lamp 10 (i.e. between electrodes 16, 18) is not sufficient to create a current arc through the gas in lamp 10. Consequently, all current flows through starter switch 20 and no current flows through lamp 10.

When electrons are being emitted from filaments 16A, 18A in sufficient quantity and inductor 13 has been sufficiently charged, starter switch 20 is opened. When the current flow through switch 20 is cut off, the magnetic field induced in inductor 13 collapses, causing an inductive voltage spike. This inductive voltage spike provides the ignition voltage across lamp 10 (i.e. between electrodes 16, 18), which in turn ionizes the gas in lamp 10 and creates an arc of current that flows between electrodes 16, 18.

After an arc has been initiated, current now flows through lamp 10. Current flow is maintained through lamp 10 by electrons emitted from hot filaments 16A, 18A and by the ionized gas particles in lamp 10. When current starts to flow through lamp 10, filaments 16A, 18A start to cool down somewhat because current is no longer flowing through switch 20 and through filaments 16A, 18A. However, filaments 16A, 18A tend to stabilize at a slightly reduced temperature because current flow through lamp 10 tends to heat filaments 16A, 18A (when electrodes 16, 18 are acting as cathodes). Arc current flowing through electrodes 16, 18 tends to heat filaments 16A, 18A sufficiently to maintain the filaments 16A, 18A at an emitting temperature.

Heat generated by the arc discharge in lamp 10 provides energy to the mercury in lamp 10, increasing its vapor pressure. Collisions between charged particles and gaseous mercury atoms cause electrons in the gaseous mercury atoms to occupy higher energy states. When these mercury electrons return to their ground energy state, they release ultra-violet photons. Lamp 10 is typically coated with phosphors (not shown), which absorb the ultraviolet photons. Absorption of ultraviolet photons causes the electrons of the phosphor atoms to occupy higher energy states. When these phosphor electrons return to their ground energy state, they release photons in the visible spectrum.

While an arc is maintained through lamp 10, the resistance through lamp 10 (i.e. between electrode 16 and electrode 18) decreases. More specifically, the flow of electrons and ions though lamp 10 creates collisions with other atoms, liberating more ions and electrons and facilitating the flow of more current. Inductive ballast 12 helps prevent damage to filaments 16A, 18A and lamp 10 by limiting the total current through lamp 10. Since power supply 14 provides a known AC signal, the inductance of inductor 13 may be selected appropriately to limit the current through lamp 10 to a desired level.

A significant drawback of prior art ballasts is cathode degradation. As discussed above, filaments 16A, 18A are typically coated with thermionic emission materials to increase electron emission. Evaporation and/or ion bombardment can remove these materials from filaments 16A, 18A and may cause deposition of these materials on the glass walls of lamp 10 in a process referred to as "sputtering". As thermionic emission material is sputtered onto the glass walls of lamp 10, the material can trap gas molecules contained in lamp 10, reducing the internal gas pressure within lamp 10. Sputtering is a significant cause of damage to, and failure of, fluorescent lights.

Sputtering is caused by evaporation of thermionic emission material from filaments 16A, 18A when filaments 16A, 18A are overheated, for example, by the preheating current and/or the operating current. It is desirable, during preheating and operation, to increase the temperature of filaments 16A, 18A to a level where electrons are thermionically emitted from filaments 16A, 18A, while preventing the temperature of filaments 16A, 18A from increasing to the point where thermionic emission material evaporates from filaments 16A, 18A.

Sputtering is also caused by ion bombardment when the voltage difference between a filament 16A, 18A and the gas which surrounds filament 16A, 18A is too high. Ion bombardment typically occurs when this voltage difference is on the order of 3.5V-4V or higher. Under such conditions, positive gaseous ions in lamp 10 may accelerate towards filaments 16A, 18A with velocities which can cause impact damage to filaments 16A, 18A. When the voltage difference between a filament 16A, 18A and the surrounding gas is less than 3.5V-4V, the positive ions typically do not accelerate to damaging velocities. Sputtering caused by ion bombardment is prevalent during preheating, when the number of electrons that have been emitted from filaments 16A, 18A is relatively low.

Lamp damage caused by sputtering reduces the useful life of flourescent lamps. Typical prior art ballasts provide up to 100,000 lamps starts, after which the damage to the lamp has become so significant, that the lamp is unusable. In addition, sputtering reduces the efficiency of fluorescent lamps. Typical prior art lamps are about 30% efficient (i.e. in terms of a ratio of power coming out in the form of light energy to electrical input power), but this efficiency drops with age as sputtering causes blackening of the lamp inner surfaces and also causes an increasing loss of internal gas pressure. Within a few years of operation, the efficiency of prior art lamps has typically reduced to approximately half of their original efficiency (~15%).

Fluorescent lamps, known as "rapid start" lamps, incorporate the same basic principles as the lamps described above, except that rapid start ballasts are designed to provide heater current (to filaments) at all times. Other modern fluorescent lamps, known as "instant start" lamps, incorporate a ballast design which eliminates the preheating stage and ignites current flow through the lamp with exceptionally high voltage signals. The exceptionally high voltages associated with instant start lamps can cause additional damage to the filaments.

Some fluorescent lighting incorporates electronic ballasts which use inverters to transform the 60 Hz power line frequency to a higher frequency signal, typically in a range of 20 kHz-50 kHz. Fluorescent lights incorporating electronic ballasts also suffer from filament degradation due to sputtering.

It is generally desirable to provide economical methods and systems for operating fluorescent lights which reduce filament degradation due to sputtering.

Another drawback with prior art fluorescent lamps is that they are not conducive to wide range dimming which is desirable for energy conservation. Various efforts have been made to provide dimming ballasts in the prior art, but have had limited success because of general public disinterest and because of the high price of components for such dimming ballasts. It is desirable to provide economical systems and methods for starting and operating fluorescent lights which allow the light emitted from a fluorescent lamp to be efficiently dimmed over a relatively large controllable dimming range.

SUMMARY OF THE INVENTION

One aspect of the invention provides a system for operating a fluorescent light, the system comprising: a fluorescent lamp comprising at least one electrode, the at least one electrode comprising at least one corresponding filament; a filament signal power supply connected to output a filament signal and to create a corresponding filament current through the at least one filament, the filament current having a filament frequency; and a plasma signal power supply connected to output a plasma signal and to create a corresponding plasma current between the at least one electrode and a gas contained in the lamp, the plasma current having a plasma frequency; wherein the plasma frequency is greater than the filament frequency.

Another aspect of the invention provides a method for operating a fluorescent light, the method comprising: providing a fluorescent lamp comprising at least one electrode, the at least one electrode having a corresponding filament; generating a filament signal which creates a filament current through the at least one filament, the filament current having a filament frequency; generating a plasma signal which creates a plasma current between the at least one electrode and a gas contained in the fluorescent lamp, the plasma current having a plasma frequency; wherein the plasma frequency is greater than the filament frequency.

Another aspect of the invention provides a system for operating a fluorescent light, the system comprising: a fluorescent lamp comprising at least one electrode, the at least one electrode comprising at least one corresponding filament; a filament signal power supply connected to output a filament signal and to create a corresponding filament current through the at least one filament, the filament current having a filament frequency; and a plasma signal power supply connected to output a plasma signal and to create a corresponding plasma current between the at least one electrode and a gas contained in the lamp, the plasma current having a plasma frequency; wherein the filament signal power supply is configured to commence outputting the filament signal in response to an ON/OFF signal and wherein the plasma signal power supply is configured to commence outputting the plasma signal after a preheat period Δ, the preheat period Δ commencing in response to the ON/OFF signal.

Another aspect of the invention provides a method for operating a fluorescent light, the method comprising: providing a fluorescent lamp comprising at least one electrode, the at least one electrode comprising at least one corresponding filament; generating a filament signal which creates a filament current through the at least one filament, the filament current having a filament frequency; generating a plasma signal which creates a plasma current between the at least one electrode and a gas contained in the fluorescent lamp, the plasma current having a plasma frequency; wherein generating the filament signal comprises commencing outputting the filament signal in response to an ON/OFF signal and wherein generating the plasma signal comprises commencing outputting the plasma signal after a preheat period Δ, the preheat period Δ commencing in response to the ON/OFF signal.

Further features and applications of specific embodiments of the invention are described below.

BRIEF DESCRIPTION OF THE DRAWINGS

In drawings which illustrate non-limiting embodiments of the invention.

DESCRIPTION

Figure 1:
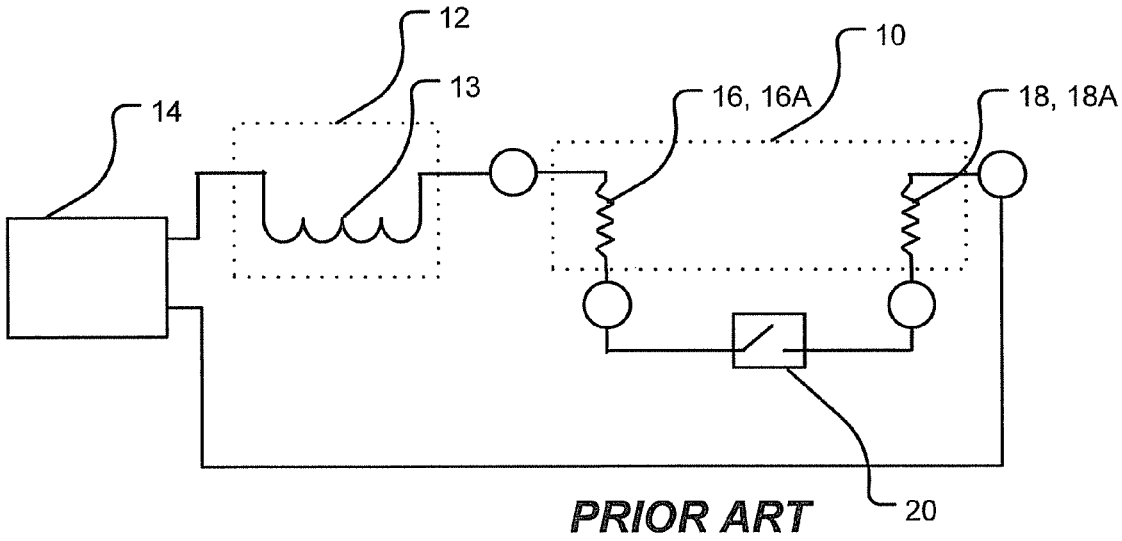
FIG. 1 is a schematic illustration of a prior art fluorescent lamp.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

One aspect of the invention provides a fluorescent light system comprising separate power supplies for delivering a plasma signal and a filament signal which in turn provide plasma current and filament current to one or more fluorescent lamps. The frequency of the plasma signal may be higher than the frequency of the filament signal. Filament current alone is used to preheat the filaments of the fluorescent lamp. The filament signal may be controlled, such that the filament temperature during the preheat phase (and, subsequently, during operation of the light) is conducive to thermionic emission of electrons, but is insufficient to cause evaporation of thermionic emission material from the filaments. After a short delay to allow for preheating, a relatively high frequency plasma signal is introduced by the plasma signal power supply. The plasma signal may comprise an oscillatory signal having a plasma signal frequency greater than or equal to a dimming frequency threshold.

The dimming frequency threshold may be selected to confine the expected value of the distance traveled by electrons during a half period of the plasma signal (for at least some amplitudes of the plasma signal) to less than a distance between the electrodes of the lamp (in the case of a two electrode lamp) or less than a length of the lamp (in the case of a single electrode lamp). The expected value of the distance traveled by electrons during a half period of the plasma signal may be referred to as a confinement region. In some embodiments, the confinement region is less than 50% of the length of the lamp (in the case of a single electrode lamp) or 50% of the distance between the two electrodes (in the case of a two electrode lamp). In some embodiments, the confinement region is less than 25% of the length of the lamp (in the case of a single electrode lamp) or 25% of the distance between the two electrodes (in the case of a two electrode lamp).

In some embodiments, the dimming frequency threshold of the plasma signal is above 150 kHz. In some embodiments, the dimming frequency threshold of the plasma signal is above 250 kHz. In some embodiments, the dimming frequency threshold of the plasma signal is above 500 kHz. In particular embodiments, the dimming frequency threshold of the plasma signal is above 2 MHz. In some embodiments, a ratio of the frequency of the plasma signal to the frequency of the filament signal is 5:1 or greater. In other embodiments, the ratio of the frequency of the plasma signal to the frequency of the filament signal is 10:1 or greater. In particular embodiments, the ratio of the frequency of the plasma signal to the frequency of the filament signal is 50:1 or greater. The dimming frequency threshold of specific embodiments may depend on a number of factors, such as the dimensions of the fluorescent lamp. When the frequency of the plasma signal is greater than the dimming frequency threshold, the power of the plasma signal may be adjusted to vary the luminosity output of the fluorescent lamp, thereby permitting dimming of the fluorescent light.

The power of the plasma signal and the corresponding dimming of a fluorescent lamp may be controlled by a dimming input (e.g. by an amplitude of a dimming input). At some dimming input levels, a light-emission region of the lamp (corresponding generally to the lamp region which is occupied by plasma) occupies the entire distance between electrodes (in a two electrode lamp) or substantially the entire length of the lamp (in the case of a single electrode lamp). However, when the dimming input is below a certain level, the confinement of electrons and the correspondingly low plasma signal power localize the plasma to the ends of the lamp adjacent the electrodes (in a two electrode lamp) or to the end of the lamp adjacent the electrode (in the case of a single electrode lamp). For two electrode lamps, when the plasma is localized in this manner, the corresponding light-emission regions of the lamp are also localized to the ends of the lamp adjacent the electrodes and there is a central non-light-emission region between the two light-emission regions. For a single electrode lamp, when the plasma is localized in this manner, the corresponding light emission region is proximate to the electrode and there is a distal non-light-emission region at the end of the lamp opposing the electrode. For example, at some dimming input levels, each of the light-emission regions of the lamp may occupy less than the 50% distance between electrodes (in a two electrode lamp) or less than the length of the lamp (in the case of a single electrode lamp). At some dimming input levels, each of the light-emission regions of the lamp may occupy less than 25% of the distance between electrodes (in a two electrode lamp) or less than 50% of the length of the lamp (in the case of a single electrode lamp). At some dimming input levels, each of the light-emission regions of the lamp may occupy less than 12.5% of the distance between electrodes (in a two electrode lamp) or less than 25% of the length of the lamp (in the case of a single electrode lamp). In general, for a given dimming level, the light-emission region will be smaller when the frequency of the plasma signal is higher.

Figure 2:
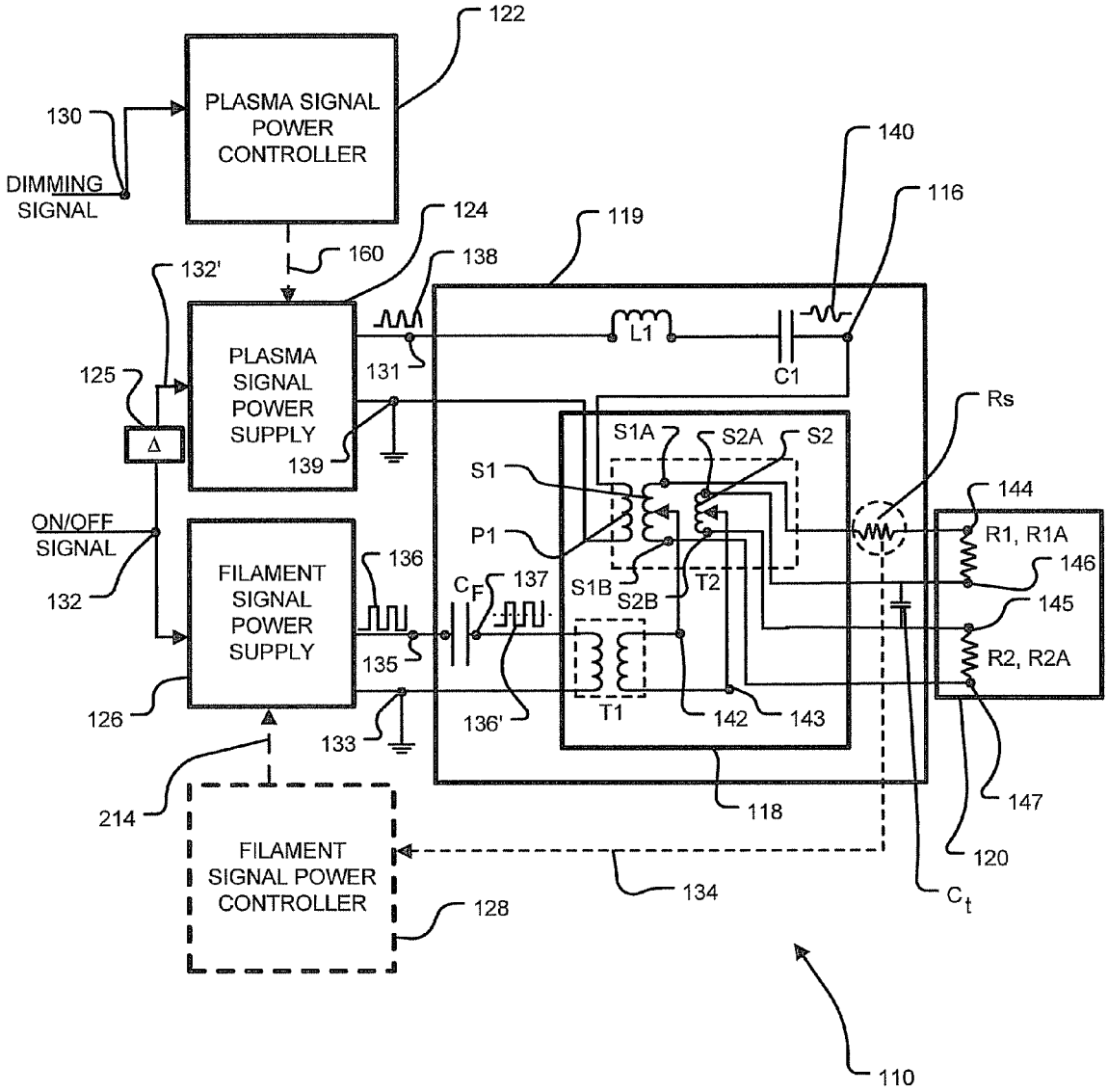
FIG. 2 is a schematic diagram of a fluorescent light system according to a particular embodiment of the invention.

FIG. 2 schematically depicts a system 110 for operating a fluorescent lamp 120 according to a particular embodiment of the invention. Fluorescent lamp 120 comprises a pair of electrodes $R_1$, $R_2$, each of which comprises a corresponding filament $R_{1A}$, $R_{2A}$. System 110 comprises a plasma signal power supply 124, a filament signal power supply 126 and a matcher/combiner 119. As explained further below, system 110 is controlled by ON/OFF signal 132 (typically a user input, but possibly an automated input). In response to activation of ON/OFF signal 132, filament signal power supply 126 and plasma signal power supply 124 provide AC power to matcher/combiner 119. Matcher/combiner 119 comprises a transformer unit 118 which, in turn, supplies filament current to filaments $R_{1A}$, $R_{2A}$ of electrodes $R_1$, $R_2$ and plasma current to lamp 120.

In the illustrated embodiment, system 110 also comprises plasma signal power controller 122 and optional filament signal power controller 128. Plasma signal power controller 122 receives dimming signal 130 (typically a user input, but possibly an automated input) and controls plasma signal power supply 124 to adjust the luminosity output of lamp 120 (i.e. to cause dimming of lamp 120). Optional filament signal power controller 128 may control the output of filament signal power supply 126 to regulate the temperature of filaments $R_{1A}$, $R_{2A}$ and thereby minimize filament damage.

To turn on fluorescent lamp 120, ON/OFF signal 132 is activated and dimming signal 130 is set to some level between 0%-100%. In some embodiments, ON/OFF signal 132 is provided by a conventional ON/OFF switch (not explicitly shown) and a user turns the switch to an ON position to activate ON/OFF signal 132. Dimming signal 130 may be preset (i.e. prior to activating ON/OFF signal 132) or may be adjusted after ON/OFF signal 132 is activated. Dimming signal 130 is indicative of a dimming range between 0%-100%. By way of non-limiting example, dimming signal 130 may be implemented by a user-adjustable potentiometer (not explicitly shown) which may be configured in a voltage divider circuit. In other embodiments, dimming signal 130 may be provided using other digital or analog means which will be understood to those skilled in the art in view of the disclosure herein. For the purposes of explaining system 110 of FIG. 2, it is assumed that dimming signal 130 is set to 100%. Adjustment of dimming signal 130 will be explained in more detail below.

Filament signal power supply 126 receives ON/OFF signal 132. When ON/OFF signal 132 is activated, filament signal power supply 126 outputs AC filament signal 136. As shown in FIG. 2, AC filament signal 136 may be a square wave signal. In some embodiments, the frequency of AC filament signal 136 is in a range of 10 kHz-200 kHz. In particular embodiments, the frequency of AC filament signal 136 is in a range of 20 kHz-75 kHz. In some embodiments, it may be desirable to make AC filament signal 136 have a frequency that is sufficiently high so as to avoid audible frequencies and to avoid the need for unnecessarily large transformers. In some embodiments, it may be desirable to make AC filament signal 136 have a frequency that is sufficiently low to minimize the so called skin effect in filaments $R_{1A}$, $R_{2A}$. The frequency of AC filament signal 136 may be dependent on the characteristics of transformer unit 118. In some embodiments, AC filament signal 136 has a duty cycle of approximately 50%, although this is not necessary.

AC filament signal 136 may alternate between ground and some non-zero peak amplitude. In particular embodiments, the peak voltage amplitude of AC filament signal 136 is in a range of 12-24 V. In other embodiments, the peak voltage of AC filament signal 136 may be outside of this range. In still other embodiments, AC filament signal 136 may oscillate between a maximum peak above zero and a minimum peak below zero. AC filament signal 136 may have an amplitude which depends on the characteristics (e.g. winding ratios) of transformer unit 118 and/or the characteristics (e.g. resistance) of filaments $R_{1A}$, $R_{2A}$. The characteristics of AC filament 136 may be selected to realize particular signal characteristics on filaments $R_{1A}$, $R_{2A}$. In the particular cases (e.g. typical rapid start fluorescent lamps), it is desirable that the signal on filaments $R_{1A}$, $R_{2A}$ be ~3.5V RMS or thereabouts, although other voltage levels may be desirable for other types of lamps and/or other types of filaments.

In some embodiments, optional filament signal power controller 128 controls the amplitude of AC filament signal 136 using feedback signals 214 and 134. Feedback signal 134 may comprise one or more sensed parameters indicative of the temperature of filaments $R_{1A}$, $R_{2A}$. For example, such feedback signal 134 may comprise sensed values of the current through one or both of filaments $R_{1A}$, $R_{2A}$ which may be correlated to the temperature of filaments $R_{1A}$, $R_{2A}$. Feedback signal 214 may comprise a control signal input to filament signal power supply 126 which causes filament signal power supply 126 to controllably vary characteristics of AC filament signal 136 to achieve a desired temperature of filaments $R_{1A}$, $R_{2A}$. The operation of a particular exemplary embodiment of optional filament signal power controller 128 is explained in more detail below.

Capacitor $C_F$ removes DC components from AC filament signal 136, resulting in filtered AC filament signal 136' at node 137 as shown in FIG. 2. In particular embodiments, capacitor $C_F$ is selected to be relatively large so as to substantially eliminate DC components from filtered AC filament signal 136' and to substantially minimize potential resonance problems. Capacitor $C_F$ may be selected to minimize undesirable attenuation of the AC component of filament signal 136. In the illustrated embodiment, capacitor $C_F$ is shown as a part of matcher/combiner 119. This is not necessary, in some embodiments, capacitor $C_F$ may be connected between matcher/combiner 119 and filament signal power supply 126.

Filtered AC filament signal 136' will typically have a frequency and duty cycle similar to those of AC filament signal 136. However, with the DC components substantially eliminated, filtered AC filament signal 136' will oscillate around zero. In particular embodiments, filtered AC filament signal 136' may oscillate between voltage peaks of ±1V to ±12V, although filtered AC filament signal 136' may have different amplitudes.

In the FIG. 2 embodiment, transformer unit 118 comprises a pair of transformers $T_1$ and $T_2$. Transformer $T_1$ may comprise a conventional single input-single output transformer (e.g. a uniform ferrite core transformer). Transformer $T_2$, on the other hand, may comprise a single input-dual output transformer, wherein a signal on its primary winding $P_1$ is transferred to a pair of secondary windings $S_1$, $S_2$. In the illustrated embodiment, each of secondary windings $S_1$, $S_2$ comprises a center-tap conductor, the function of which is described in more detail below. Transformer $T_2$ is preferably a RF transformer and may also comprise a uniform ferrite core.

Filtered AC filament signal 136' appears across the primary winding of transformer $T_1$. In one particular embodiment, filtered AC filament signal 136' is stepped down as it is transferred from the primary winding to the secondary winding of transformer $T_1$. By way of non-limiting example, the voltage amplitude of the signal on the secondary winding of transformer $T_1$ may be stepped down to a range of 3-4 volts RMS. For typical rapid start lamps, the voltage on the secondary winding of transformer $T_1$ may be ~3.5 V RMS. In other embodiments (e.g. for other types of lamps or other types of filaments), the voltage amplitude of the stepped down AC voltage signal generated in the secondary winding of transformer $T_1$ may have other values.

The stepped-down AC voltage signal generated in secondary winding of transformer $T_1$ is then provided to the center-taps 142, 143 of the secondary windings $S_1$, $S_2$ of RF transformer $T_2$. Preferably, secondary windings $S_1$, $S_2$ are selected to have properties such that, at the relatively low frequency of AC filament signal 136, windings $S_1$, $S_2$ have minimal inductive effect. The stepped-down AC signal at center-tap 142 propagates via coil $S_1$ to node 144 of filament $R_{1A}$ and to node 147 of filament $R_{2A}$. Similarly, the stepped-down AC signal at center-tap 143 propagates via coil $S_2$ to node 146 of filament $R_{1A}$ and to node 145 of filament $R_{2A}$. The stepped-down AC signal appearing between nodes 144, 146 of filament $R_{1A}$ creates a current between nodes 144, 146 (i.e. through filament $R_{1A}$) and the stepped-down AC signal appearing between nodes 145, 147 of filament $R_{2A}$ creates a similar current between nodes 145, 147 (i.e. through filament $R_{2A}$). This current through filaments $R_{1A}$, $R_{2A}$, heats filaments $R_{1A}$, $R_{2A}$ and causes filaments $R_{1A}$, $R_{2A}$ to thermionically emit electrons.

In particular embodiments, the amplitude of AC filament signal 136, the capacitance of capacitor $C_F$, the characteristics of transformers $T_1$, $T_2$ and the characteristics of filaments $R_{1A}$, $R_{2A}$ (and their coatings of thermionic emission material) are selected, such that the current flow through filaments $R_{1A}$, $R_{2A}$ raises the temperature of filaments $R_{1A}$, $R_{2A}$ to the point where filaments $R_{1A}$, $R_{2A}$ thermionically emit electrons, but not to the point where thermionic emission material evaporates from filaments $R_{1A}$, $R_{2A}$. As discussed above and in more detail below, optional filament signal power controller 128 may control the amplitude of AC filament signal 136 using feedback signals 134 and 214. Such control may comprise analog or digital control and may be active throughout the operation of lamp 120 or only during the preheat phase.

Plasma signal power supply 124 does not take part in the preheating process. In the illustrated embodiment, system 110 comprises a delay unit 125. When ON/OFF signal 132 is activated, delay unit 125 introduces a preheat delay period Δ before delayed ON/OFF signal 132' is received at plasma signal power supply 124. Preferably, the preheat delay period Δ is long enough to allow filament signal power supply 126 to heat filaments $R_{1A}$, $R_{2A}$ to a desired emission temperature. In some embodiments, the preheat delay period Δ is in a range of 500 ms-4 s. Delay unit 125 may be implemented by suitable analog or digital circuitry which will be familiar to those skilled in the art. In other embodiments, delay unit 125 may be incorporated into plasma signal power supply 124 and/or into plasma signal power controller 122.

After the preheat delay period Δ, plasma signal power supply 124 outputs AC plasma signal 138 between nodes 131, 139. AC plasma signal 138 may vary between ground and some voltage amplitude level and may have an approximately half sinusoidal shape as explained in more detail below. The amplitude of AC plasma signal 138 depends on dimming input 130 provided to plasma signal power controller 122 and in turn on dimming control signal 160 provided by plasma signal power controller 122 to plasma signal power supply 124. In particular embodiments, the peak amplitude of AC plasma signal 138 varies in a range of 0V-100V, but this range may generally be different (e.g. 0V-24V, for example).

AC plasma signal 138 has a frequency that is greater than that of AC filament signal 136 and preferably has a frequency that is above a dimming frequency threshold. The dimming frequency threshold of AC plasma signal 138 may be over 150 kHz. In some embodiments, the dimming frequency threshold of AC plasma signal 138 may be over 250 kHz. In some embodiments, the dimming frequency threshold of AC plasma signal 138 may be over 500 kHz. In particular embodiments, the dimming frequency threshold of AC plasma signal 138 is above 2 MHz. The dimming frequency threshold may be selected to confine the expected value of the distance traveled by electrons during a half period of the plasma signal (for at least some power levels of the plasma signal) to less than a distance between the electrodes of the lamp (in the case of a two electrode lamp) or less than a length of the lamp (in the case of a single electrode lamp). In such cases, the confinement region (i.e. the expected value of the distance traveled by electrons during a half period of the plasma signal) may be such that electrons are expected to travel between a single electrode and the gas in the lamp but are not expected to travel between electrodes during a single half period of the plasma signal. In some embodiments, the ratio of the frequency of AC plasma signal 138 to the frequency of AC filament signal 136 is above 10. In particular embodiments, the ratio of the frequency of AC plasma signal 138 to the frequency of AC filament signal 136 is above 50.

Inductor $L_1$ and capacitor $C_1$ form a series resonant filter. The inductance of inductor $L_1$ and the capacitance of capacitor $C_1$ may be selected to have a resonant frequency which is substantially similar to the frequency of AC plasma signal 138 and may be used to remove the DC component and tune out harmonics from AC plasma signal 138. Together, inductor $L_1$ and capacitor $C_1$ filter AC plasma signal 138, create a sinusoidal (or approximately sinusoidal) filtered AC plasma signal 140 at node 116. Filtered AC plasma signal 140 varies between positive and negative peaks and has a frequency that is substantially similar to the frequency of AC plasma signal 138. In particular embodiments, primary winding $P_1$ of transformer $T_2$ is selected to have a relatively small number of windings, such that it provides relatively low impedance and the corresponding voltage of filtered AC plasma signal 140 at node 116 is relatively low. The low impedance of winding $P_1$ may be selected to help match the output impedance of the amplifier (not shown) of plasma signal power supply 124.

Filtered AC plasma signal 140 appears across primary winding $P_1$ of transformer $T_2$. Corresponding AC plasma signals are created in secondary windings $S_1$, $S_2$ of transformer $T_2$. As shown in FIG. 2, nodes $S_{1A}$, $S_{2A}$ of secondary bifilar windings $S_1$, $S_2$ are respectively connected to nodes 144, 146 of electrode $R_1$ and nodes $S_{1B}$, $S_{2B}$ of secondary bifilar windings $S_1$, $S_2$ are respectively connected to nodes 145, 147 of electrode $R_2$. With this configuration, the plasma signals created in secondary windings $S_1$, $S_2$ of transformer $T_2$ do not create a voltage difference across filaments $R_{1A}$, $R_{2A}$, but rather create a voltage difference between electrodes $R_1$, $R_2$.

When the amplitude of the AC plasma signal at nodes $S_{1A}$, $S_{2A}$ of secondary windings $S_1$, $S_2$ is high (e.g. at or near its positive maximum), the amplitude of the AC plasma signal at nodes 144, 146 of electrode $R_1$ is correspondingly high and the amplitude of the AC plasma signal at nodes 145, 147 of electrode $R_2$ is correspondingly negative. Similarly, when the amplitude of the AC plasma signal at nodes $S_{1B}$, $S_{2B}$ of secondary windings $S_1$, $S_2$ is high (e.g. at or near its positive maximum), the amplitude of the AC plasma signal at nodes 145, 147 of electrode $R_2$ is correspondingly high and the amplitude of the AC plasma signal at nodes 144, 146 of electrode $R_1$ is correspondingly negative. In other words, the AC plasma signal at electrode $R_1$ is opposite in phase (i.e. approximately 180° out of phase) with the AC plasma signal at electrode $R_2$. In this manner, AC plasma signal 138 output from plasma signal power supply 124 creates a voltage difference across lamp 120 (i.e. between electrodes $R_1$, $R_2$).

In the illustrated embodiment, matcher/combiner 119 comprises a tuning capacitor $C_t$. Capacitor $C_t$, in combination with the inductance of windings $P_1$, $S_1$, $S_2$ of transformer $T_2$ and the impedance of lamp 120, provide a resonant circuit. The capacitance of capacitor $C_t$ may be selected such that the resonant frequency of this circuit corresponds with the frequency of AC plasma signal 138. Preferably, capacitor $C_t$ and the components of transformer $T_2$ are selected to provide the resultant resonant circuit with a relatively high quality factor (Q factor). In some embodiments, the Q factor of this circuit is in a range of 50-250. With such resonant frequency tuning and such a high Q factor, the voltage of the AC plasma signals on secondary windings $S_1$, $S_2$ is sufficiently large to create an ignition voltage (e.g. in a range 20-50V RMS) between electrodes $R_1$, $R_2$.

The AC signal between electrodes $R_1$, $R_2$ of lamp 120 (which may be in a range of 20-50V RMS) provides an ignition voltage in lamp 120. More particularly, the AC signal between electrodes $R_1$, $R_2$ tends to create a potential gradient in the gas between electrodes $R_1$, $R_2$ and the surrounding gas. This AC potential gradient ionizes the gas in lamp 120 and creates a current flow between electrodes $R_1$, $R_2$ and the surrounding gas. This current flow between electrodes $R_1$, $R_2$ and the surrounding gas may be referred to as plasma current.

During portions of a period where there is a large negative voltage on electrode $R_1$ (i.e. when $R_1$ is acting as a cathode), this negative voltage tends to cause positive gas ions located in lamp 120 to accelerate toward electrode $R_1$ (see above discussion of ion bombardment). Similarly, during portions of a period when there is a large negative voltage on electrode $R_2$ (i.e. when $R_2$ is acting as a cathode), positive ions accelerate toward electrode $R_2$. However, because of delay element 125, the large AC power signals on electrodes $R_1$, $R_2$ caused by plasma signal power supply 124 and plasma signal 138 do not occur until after the preheat delay period Δ.

During the preheat delay period Δ, filament power supply 126 heats filaments $R_{1A}$, $R_{2A}$ of electrodes $R_1$, $R_2$ and causes a large number of electrons to be thermionically emitted from filaments $R_{1A}$, $R_{2A}$ into the space around electrodes $R_1$, $R_2$, as described above. Once the thermionic emitting material on filaments $R_{1A}$, $R_{2A}$ reaches emitting temperature, the thermionically emitted electrons form a space charge which tends to neutralize and slow down positive ions before they impact electrodes $R_1$, $R_2$ (i.e. when electrodes $R_1$, $R_2$ are acting as cathodes). Accordingly, despite the large voltage on electrodes $R_1$, $R_2$, sputtering by ion bombardment is minimized or essentially eliminated by the presence of thermionically emitted electrons generated by filament power supply 126 during the preheat period Δ and during lamp operation.

The flow of plasma current between electrodes $R_1$, $R_2$ and the surrounding gas is maintained by the thermionically emitted electrons (from the filaments of electrodes $R_1$, $R_2$) and by the electrons and ionized gas particles in lamp 120. The filament current generated by filament signal power supply 126 and filament signal 136 maintains the temperature of filaments $R_{1A}$, $R_{2A}$ at a temperature hot enough to continue thermionically emitting electrons, but, preferably, not hot enough to cause substantial evaporation of thermionic emission material. This contrasts with prior art methods where filament temperature is maintained by ion bombardment. Once a plasma current is established between electrodes $R_1$, $R_2$ and the surrounding gas, light is emitted from lamp 120 as discussed above.

After a plasma current is established in lamp 120, the impedance to plasma current flow in lamp 120 tends to decrease as a function of power level. More specifically, the flow of electrons and ions within lamp 120 creates collisions with other atoms, liberating more ions and electrons and facilitating the flow of more plasma current. Together, plasma signal power supply 24 and matcher/combiner 119 may be designed to limit the plasma current flow within lamp 120. In particular embodiments, transformer $T_2$ and capacitor $C_t$ form a parallel resonant circuit which presents a high impedance that can offset the effect of the decreasing resistance in lamp 120.

Dimming signal 130 allows a user, an automated process or the like to control the light output of lamp 120. More specifically, dimming signal 130, which may be an analog or digital signal and may range from 0-100%, provides an indication of dimming level to plasma signal power controller 122 which in turn controls the maximum amplitude (e.g. peak voltage) of AC plasma signal 138. In one embodiment (explained further below), plasma signal power controller 122 controls the peak voltage of AC plasma signal 138 by controlling a DC voltage level (dimming control signal 160 in the FIG. 2 embodiment) supplied to plasma signal power supply 124.

Reducing the peak voltage of AC plasma signal 138 causes the light output from lamp 120 to dim. In some embodiments, the controllable dimming ratio of system 110 (i.e. the ratio of the maximum controllable luminosity output to the minimum controllable luminosity output) is over 1000:1. In particular embodiments, the controllable dimming ratio of system 110 is over 4000:1. In some embodiments, the ratio of the maximum plasma current power to the minimum plasma current power is over 1000:1. In some embodiments, this plasma current power ratio is over 4000:1. In prior art fluorescent lights which operate with low frequency plasma signals (e.g. below a dimming frequency threshold of 150 kHz), reducing the amplitude of the plasma signal causes the light output of the lamp to quickly reduce to zero because of inherent losses in the lamp. Without wishing to be bound by theory, it is believed that these losses may be caused by collisions between the current carrying electrons and the other particles in the plasma and wall surfaces of the lamp.

It is believed that the relatively high frequency of AC plasma signal 138 output by plasma signal power supply 124 (e.g. above a dimming frequency threshold of 150 kHz; in some embodiments, above a dimming frequency threshold of 500 kHz; above a dimming frequency threshold of 500 kHz in other embodiments; and above a dimming frequency threshold of 2 MHz in still other embodiments) allows for significantly higher dimming ratios than available in prior art fluorescent lighting systems. The particular dimming frequency threshold may depend on the dimensions of lamp 120. In particular embodiments, it may be desirable to select a dimming frequency threshold to ensure that the expected value of the distance traveled by electrons during a half-cycle of AC plasma signal 138 is less than the distance between electrodes $R_1$, $R_2$. In such embodiments, electrons may be said to be confined between a single electrode $R_1$, $R_2$ and the surrounding gas in lamp 120, as described further below.

The temperature of the electrons in the plasma of a 40 Watt T12 fluorescent lamp has been measured to be on the order of 11,000 K. Using Boltzmann's equation (equation (1)), to calculate the energy of an electron in the plasma at this temperature, and the kinetic energy of the electron according to the theory of special relativity (equation (2)), we can estimate the expected value of the distance that an electron is capable of traveling through lamp 120 during a half cycle of AC plasma signal 138 at various operating frequencies.

Boltzmann's equation is given by:

$$\xi = 3/2KT \tag{1}$$

where $K=1.38066\times10^{-23}$ Joule/Kelvin is Boltzmann's constant, and T=11000 Kelvins, which yields an energy of $\xi=2.2780857\times10^{-19}$ Joules. According to special relativity, the velocity of an electron is given by:

$$v = c\sqrt{\frac{\xi(2mc^2+\xi)}{(mc^2+\xi)^2}} \tag{2}$$

where $c=2.9979\times10^8$ m/s is the speed of light, $m=9.10939\times10^{-31}$ kg is the mass of an electron and v is the unknown speed of the electron. Using equation (2), the speed v of an electron in the plasma of a T12 fluorescent lamp at 11,000 K may be calculated to be approximately $7.0722\times10^5$ m/s (i.e. 0.236% of the speed of light).

At this velocity, it is possible to estimate an expected value of the distance that an electron could travel in the lamp plasma during a half period of AC plasma signal 138. For example, for a plasma signal having a frequency of 60 Hz, the distance that an electron could travel during a half period ($8.33\times10^{-3}$ s) is approximately 5.9 km. This distance represents a relatively large distance over which electrons could travel during a half-cycle. Without wishing to be bound by theory, it is believed that when electrons move over such a large distance, they are relatively more likely to collide with other particles present in the plasma causing them to recombine with and neutralize ions present in the plasma and ultimately cause plasma volume or wall losses. In contrast, when the plasma signal frequency is 2.5 MHz, the distance that an electron (having a similar energy) could travel during a half period ($2\times10^{-7}$ s) is approximately 14.1 cm and when the plasma signal frequency is 50 MHz, the distance that an electron (having a similar energy) could travel during a half-cycle ($10^{-8}$ s) is approximately 0.71 cm, thus dramatically reducing the potential loss area and loss volume.

Newer, T5 fluorescent lamps have a higher energy density than their older T12 counterparts. It has been estimated that 4 foot T12 lamps (operating at their full rated power of 40 Watts) have an energy density $\rho$ of $\rho$~0.47157 Watts/Inch$^3$ and that T5 lamps (operating at their full rated power of 22 Watts) have an energy density $\rho$ of $\rho$~2.53666 Watts/Inch$^3$. Using the energy density $\rho$ of the T12 lamps and the measured 11,000K temperature of the electrons in the T12 plasma, yields an energy density to temperature conversion factor $\alpha$ of $\alpha$=23326.3 (Inch$^3$ Kelvin)/Watt. Accordingly, the estimated T5 energy density at full power ($\rho$) can be converted to an electron temperature in the plasma of a T5 lamp by multiplying the energy density ($\rho$) by the conversion factor $\alpha$ to yield an electron temperature of 59170 K, which is much higher than the electron temperature in the T12 lamp. At this electron temperature, equation (2) may be used to solve for the speed v of an electron in the plasma of a T5 fluorescent lamp to be approximately $1.64024\times10^6$ m/s (i.e. ~0.55% or 1/183 of the speed of light).

The speed of the electrons in the plasma of a fluorescent lamp operating according to the invention will depend on the dimming level (e.g. dimming signal 130 and/or dimming control signal 160) at which the system is operating. The inventor has experimentally determined the speed of the electrons in the plasma of a T5 lamp at lowest dimming levels by measuring the extent of the luminosity extending from the electrode and by dividing this distance by a half period of plasma signal 138. This experimentally estimated electron velocity in a T5 lamp at low dimming levels was on the order of $4.9\times10^4$ m/s (~0.016% of the speed of light).

It will be appreciated that when the frequency of plasma signal 138 is greater, the electrons in the plasma are relatively confined (i.e. travel over smaller distances). Accordingly, while not wishing to be bound by theory, it is believed that at higher plasma signal frequencies, the current carrying electrons have less opportunity to collide with other particles in the plasma and correspondingly less opportunity to cause losses.

Without wishing to be bound by theory, it is believed that this electron confinement phenomenon makes it possible to dim the luminosity output of lamp 120 over a large dynamic range (i.e. a large dimming ratio) by controlling the peak voltage of plasma signal 138 when the frequency of plasma signal 138 is above a dimming threshold frequency. For example, the inventor has experimentally determined that when the arc signal (i.e. AC plasma signal 138) is above a frequency of 13.5 MHz, it is possible to dim the luminosity output of lamp 120 from 100% down to 0.025% in a 22 Watt T5 rapid start lamp. This represents a controllable dimming ratio of over 4000:1. In some embodiments, this dimming ratio between the highest and lowest luminosity outputs of lamp 120 is over 1000:1. Generally, the lowest dimmed power is relatively constant for a given plasma current frequency, but the highest possible power is higher in longer lamps. Accordingly, in such longer lamps, the dimming ratio is also higher.

In the above description, it was assumed that dimming signal 130 was set at 100%. Dimming signal 130 may be adjusted to a reduced value. When dimming signal 130 is adjusted to a value less than 100%, plasma signal power controller 122 outputs a correspondingly low dimming control signal 160 to plasma signal power supply 124 which in turn causes a corresponding reduction in the amplitude of AC plasma signal 138.

Figure 3:
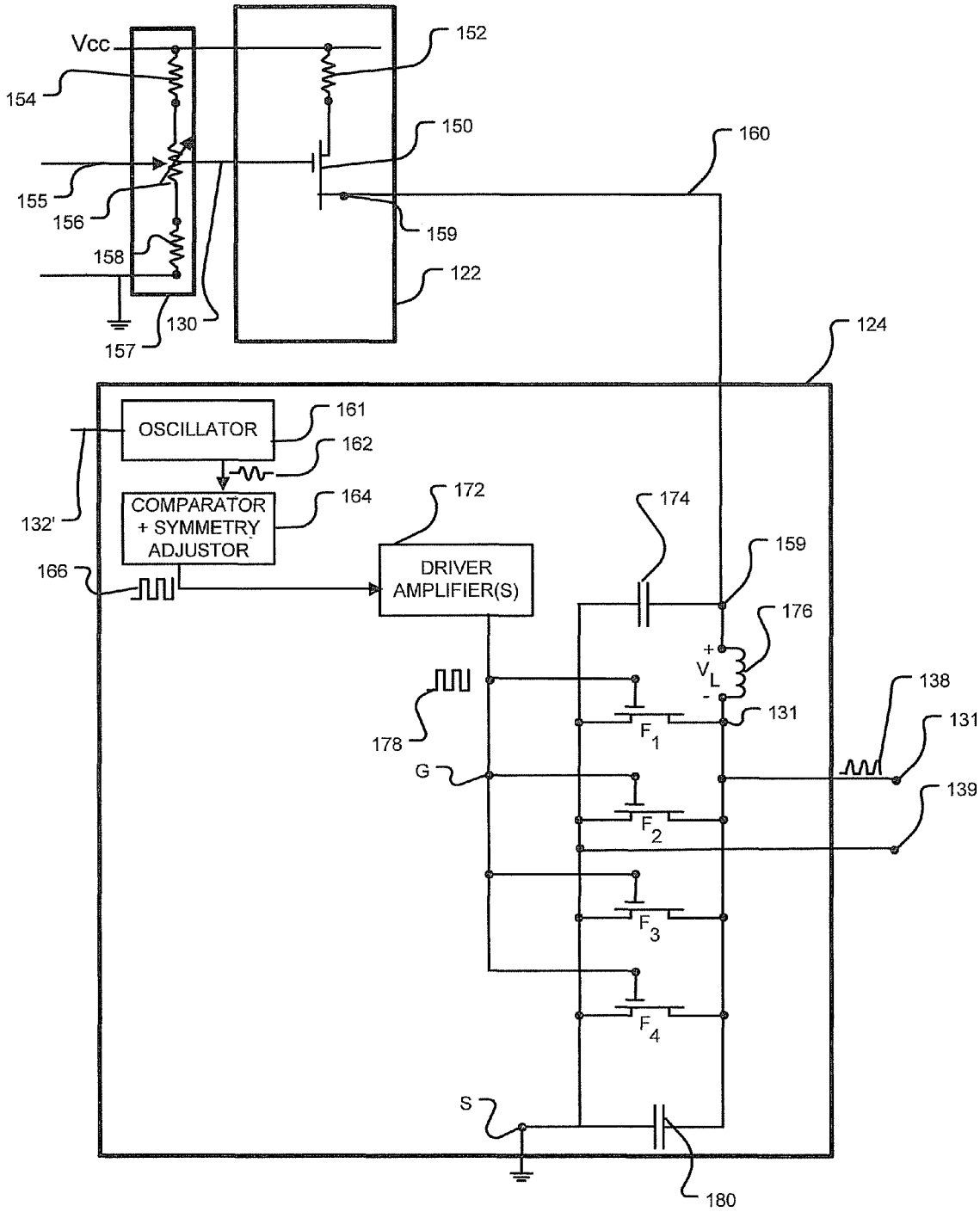
FIG. 3 is a schematic diagram of an exemplary plasma signal power controller and an exemplary plasma signal power supply that are suitable for use in the FIG. 2 system.

FIG. 3 schematically depicts one possible embodiment of plasma signal power controller 122 and plasma signal power supply 124 suitable for use with system 110 (FIG. 2). Plasma signal power controller 122 receives dimming signal 130. Dimming signal 130 may be an analog or digital signal generated by any suitable input means. In the illustrated embodiment, dimming signal 130 is provided by a voltage divider circuit 157. Voltage divider circuit 157 comprises a variable resistor 156 which has a physically manipulable resistance that varies in response to input 155. By way of non-limiting example, input 155 may include a suitable rotational or slidable mechanism. In the illustrated embodiment, variable resistor 156 includes a center-tap which provides dimming signal 130. In addition to variable resistor 156, voltage divider circuit 157 comprises a pair of additional resistors 154, 158. As shown in FIG. 3, resistors 154, 156, 158 may be connected in series between a positive DC voltage rail ($V_{cc}$) and ground. In one particular embodiment, $V_{cc}$ may be 24V, although the $V_{cc}$ value may be different.

In the illustrated embodiment, the total resistance of resistors 154, 156, 158 is constant such that the current flowing through resistors 154, 156, 158 is constant. However, manipulation of input 155 changes the amount of resistance 156 above the center-tap and thereby changes the voltage of dimming signal 130. It will be appreciated by those skilled in the art that voltage divider circuit 157 and variable resistor 156 represent only one technique for generating dimming signal 130. Other circuit designs may be envisioned which would produce a dimming signal comparable to dimming signal 130.

In the FIG. 3 embodiment of plasma signal power controller 122, dimming signal 130 is received at the gate of transistor 150. In the illustrated embodiment, transistor 150 comprises a p-channel FET transistor. When the voltage of dimming signal 130 (i.e. the voltage at the gate of p-channel FET 150) is sufficiently far below $V_{cc}$ (e.g. approximately 20V in embodiments where $V_{cc}$ is 24V), transistor 150 turns on and current conducts through transistor 150 from $V_{cc}$, through resistor 152 (connected to the source of transistor 150) and to node 159 (at the drain of transistor 150). This current flow pulls node 159 upwardly toward $V_{cc}$. In particular embodiments, where $V_{cc}$ is 24V, the voltage at node 159 may be approximately 22V when transistor 150 is turned on, as there is some voltage drop across resistor 152 and some residual voltage drop across transistor 150.

If the voltage of dimming signal 130 increases toward $V_{cc}$ (i.e. by suitable manipulation of input 155 and corresponding changes to variable resistance 156), then the gate to source voltage of transistor 150 decreases, thereby decreasing the current flow through transistor 150 and increasing the voltage drop across transistor 150 (i.e. between the source and drain of transistor 150). Consequently, the voltage at node 159 decreases. At some point (e.g. approximately 22V in embodiments where $V_{cc}$ is 24V), the gate to source differential is insufficient for transistor 150 to conduct current. When transistor 150 turns off (i.e. conducts no current), the voltage at node 159 may be a minimum, which may be close to 0V.

The voltage at node 159 represents dimming control signal 160 (see FIG. 2) which is provided to plasma signal power supply 124 and used to control the amplitude of AC plasma signal 138 as explained in more detail below. In other embodiments, plasma signal power controller 122 could be implemented using a pulse width modulation (PWM) circuit, such that dimming control signal 160 has a duty cycle that varies in correlation with dimming signal 130 (i.e rather than a DC level that varies in correlation with dimming signal 130).

As discussed briefly above, plasma signal power supply 124 receives delayed ON/OFF signal 132' and dimming control signal 160. In the illustrated embodiment of FIG. 3, plasma signal power supply 124 comprises an oscillator 161 which outputs an oscillatory signal 162 in response to the activation of delayed ON/OFF signal 132'. Oscillatory signal 162 output by oscillator 161 has the desired frequency of AC plasma signal 138. As discussed above, this frequency is preferably higher than a dimming threshold frequency.

Oscillatory signal 162 may be a sinusoid or some other form of oscillatory signal other than an ideal logical square wave. Consequently, in the illustrated embodiment, plasma signal power supply 124 comprises a comparator/symmetry adjustor 164 which "cleans up" oscillatory signal 162 to generate a "clean" square wave signal 166. Square wave signal 166 may have the same frequency as oscillatory signal 162 and AC plasma signal 138 discussed above. In other embodiments, oscillator 161 and comparator 164 may be implemented by other forms of square wave generator which output square wave signal 166.

In the illustrated embodiment, oscillator 161 only outputs oscillatory signal 162 when delayed ON/OFF signal 132' is activated and has zero output when delayed ON/OFF signal is deactivated. In other embodiments, oscillator 161 may output a constant oscillatory signal which may be gated by delayed ON/OFF signal 132' in combination with suitable logic (e.g. oscillatory output 162 of oscillator 161 or square wave output 166 of comparator/symmetry adjustor 164 may be logically ANDed with delayed ON/OFF signal 132').

While square wave signal 166 may represent a "clean" square wave signal, comparator/symmetry adjustor circuit 164 cannot typically source a great deal of current. Consequently, square wave signal 166 is provided to driver amplifier circuit 172. Driver amplifier circuit 172 comprises one or more driver amplifiers which provide one or more corresponding square wave output signals 178 at node G. In some embodiments, a plurality of driver amplifiers may be useful to satisfy the need for rapid sourcing and/or sinking of current. Square wave signal 178 at node G may have the same frequency as oscillatory signal 162 and AC plasma signal 138 discussed above and may vary between 0V and some suitable amplitude level. In some embodiments, the amplitude of square wave signal 178 is 10V, although other amplitudes may be used.

In the illustrated embodiment, square wave signal 178 at node G is connected to the gate(s) of one or more power FETs. In the illustrated embodiment, plasma signal power supply 124 comprises a plurality of FETs $F_1$-$F_4$, although a single FET may be used and other numbers of FETs may be used. Multiple FET implementations may take advantage of the generally faster switching times of smaller FETs. A plurality of FETs may also be useful to reduce their collective ON resistance and reduce corresponding power consumption. Square wave signal 178 together with FETs $F_1$-$F_4$, inductor 176 and capacitor 180 produce AC plasma signal 138 between nodes 131 and 139 (see FIGS. 2 and 3), as explained in more detail below.

Figure 5A:
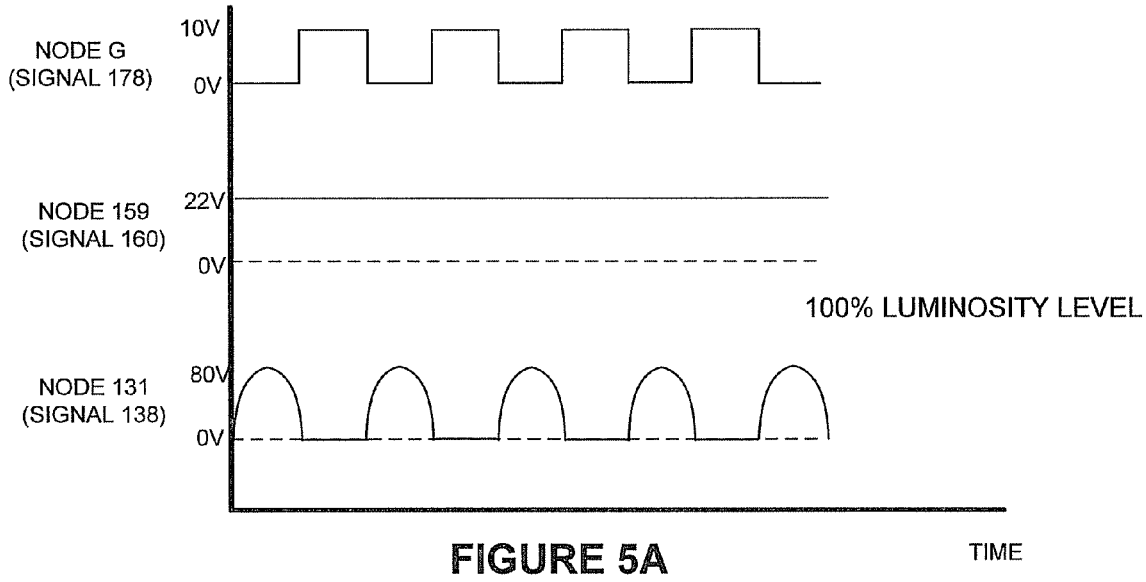
FIGS. 5A, 5B and 5C are schematic diagrams of sample waveforms at various nodes in the plasma signal power controller of FIG. 3.
Figure 5B:
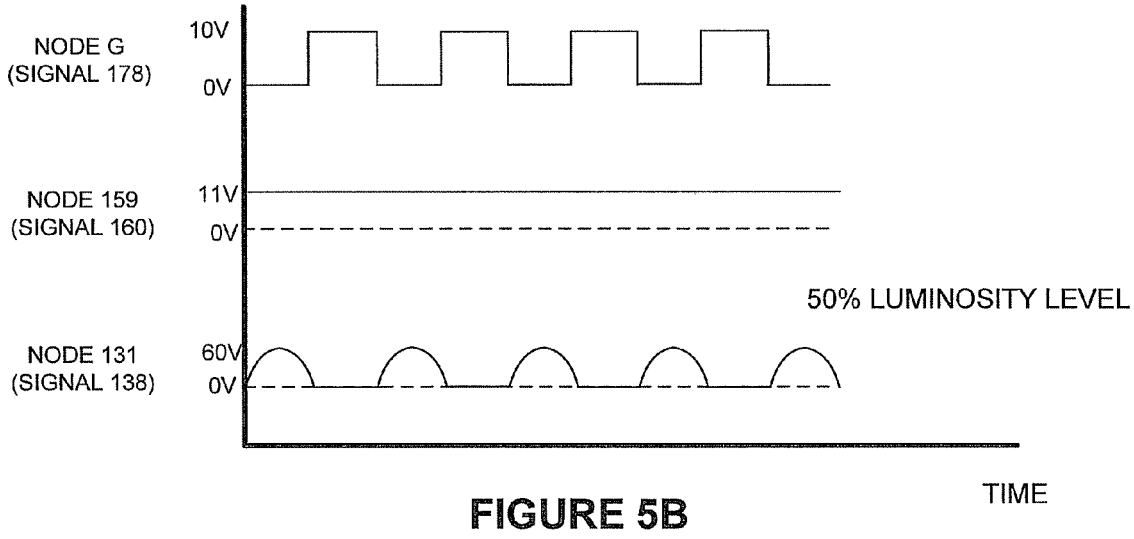
Figure 5C:
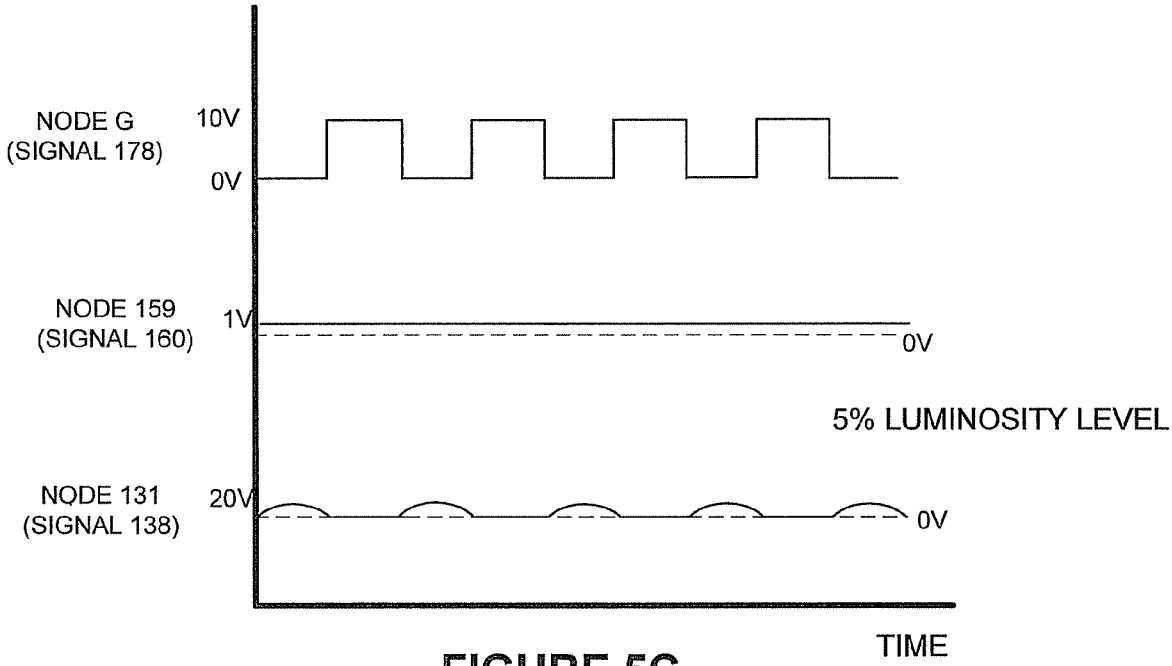

The operation of plasma signal power supply 124 to generate AC plasma signal 138 at node 131 may be understood more particularly with reference to the waveforms of FIGS. 5A-5C. Each of FIGS. 5A-5C schematically depict the signals at various nodes (nodes G, 159 and 131) of plasma signal power supply 124 for a corresponding level of dimming control signal 160 (node 159). More particularly, FIG. 5A shows the waveforms for a dimming control signal 160 of approximately 22V (i.e. ~100% luminosity), FIG. 5B shows the waveforms for a control signal 160 of approximately 11V (i.e. ~50% luminosity) and FIG. 5C shows the waveforms for a control signal 160 of approximately 1V (i.e. ~5% luminosity).

Referring to FIGS. 3 and 5A, when square wave signal 178 at node G transitions from low to high, the presence of this signal on the gates of FETs $F_1$-$F_4$, turns FETs $F_1$-$F_4$ on, causing current flow from node 159, through inductor 176 to node 131 and through FETs $F_1$-$F_4$ to node S. It is noted that node 131 corresponds to the drains of FETs $F_1$-$F_4$ and also to the node on which AC plasma signal 138 is provided to matcher/combiner 119 (see FIG. 2). It is also noted that node S corresponds to the source of FETs $F_1$-$F_4$ and may be connected to ground (see FIG. 3). The current flow through inductor 176 to node 131 induces a magnetic field in inductor 176 and the current flow through FETs $F_1$-$F_4$ to node S tends to pull node 131 down toward ground, resulting in a low (near 0V) level for AC plasma signal 138.

When square wave signals 178A, 178B transition from high to low, the signal at the gates (node G) of FETs $F_1$-$F_4$ goes to zero and FETs $F_1$-$F_4$ are turned off such that they no longer conduct current. However, there remains an induced magnetic field in inductor 176. Together, inductor 176, capacitor 180 and the impedance of matcher/combiner 119 and lamp 120 form a resonant circuit. When FETs $F_1$-$F_4$ are turned off, the current flow through inductor 176 is incapable of changing instantaneously. This current flow tends to charge capacitor 180 (see FIG. 3) and causes an increase in the voltage at node 131.

When FETs $F_1$-$F_4$ are on and the current flowing through FETs $F_1$-$F_4$ is relatively high, the voltage at node 131 can rise to a relatively high level once FETs $F_1$-$F_4$ are turned off. The voltage to which node 131 (plasma signal 138) will rise depends on the current flow through inductor 176 immediately prior to FETS $F_1$-$F_4$ turning off, which will in turn depend on the voltage at node 159 (i.e. on dimming control signal 160). This relationship between plasma signal 138 (node 131) and dimming control signal 160 (node 159) is shown explicitly in the schematic plots of FIGS. 5A, 5B, 5C which show plasma signal 138 waveforms for dimming control signal 160 voltages of 22V, 11V and 1V respectively.

In the illustrated embodiment, the voltage at node 159 is provided by dimming control signal 160 which, as discussed above, can vary in a range of approximately 0V-22V. When the voltage of dimming control signal 160 (node 159) is relatively high (e.g. as shown in FIG. 5A), there will be a relatively large current draw through inductor 176 when FETs $F_1$-$F_4$ are on, and, consequently, the increase in the voltage level at node 131 when FETs $F_1$-$F_4$ turn off will be relatively large to maintain continuous current flow through inductor 176. Conversely, when the voltage of dimming control signal 160 (node 159) is relatively low (e.g. as shown in FIG. 5C), there will be a relatively small current draw through inductor 176 when FETs $F_1$-$F_4$ are on, and, consequently, the increase in the voltage level at node 131 when FETs $F_1$-$F_4$ turn off will be relatively small to maintain continuous current flow through inductor 176.

When FETs $F_1$-$F_4$ are off, the energy stored in inductor 176 (which maintains a current flow through inductor 176) charges capacitor 180. However, some current is drawn to matcher combiner 119 (FIG. 2). As the voltage across capacitor 180 (and the corresponding voltage of plasma signal 138 and node 131) increases, the rate of this voltage increase decreases. The corresponding curvature in plasma signal 138 can be seen in FIGS. 5A, 5B, 5C. When the energy from inductor 176 has been transferred to capacitor 180, capacitor 180 then supplies the current drawn by matcher combiner 119, at which point the voltage on capacitor 180 (and the corresponding voltage of plasma signal 138 and node 131) tends to decrease. This decrease in plasma signal 138 can be seen in FIGS. 5A, 5B, 5C. Capacitor 180, inductor 176 and matcher combiner 119 may be tuned such that plasma signal (i.e. node 131) is relatively close to 0V when FETs $F_1$-$F_4$ are turned on again. Such tuning can minimize switching losses and maximize efficiency.

The inductance of inductor 176 may be selected to be relatively high to help ensure a continuous flow of current through inductor 176. In currently preferred embodiments, the inductance of inductor 176 may be in a range of 5 μH-1000 μH. Capacitor 180, which is connected between the drains (node 131) and the sources (node S) of FETS $F_1$-$F_4$, may be useful to protect FETS $F_1$-$F_4$ from damage caused by the collapse of the magnetic field in inductor 176. More particularly, capacitor 180 (in combination with L1 and C1 of matcher combiner 119—see FIG. 2) may help to control the shape of the positive half wave voltage at node 131. In the illustrated embodiment, plasma signal power supply 124 also comprises a capacitor 174 connected between node 159 and the source (node S) of FETS $F_1$-$F_4$. Capacitor 174 helps to remove high frequency components from DC dimming control signal 160 (node 159). In some embodiments, capacitor 174 is not necessary.

In accordance with this description, AC plasma signal 138 (provided at node 131) is an oscillatory signal which varies between 0V and a peak amplitude level. The shape of plasma signal 138 is similar to the positive half of a sine wave. The peak amplitude level of plasma signal 138 depends on the level of dimming control signal 160 (node 159). When dimming control signal 160 (node 159) is relatively low (e.g. FIG. 5C), then the peak amplitude of AC plasma signal 138 is also relatively low. This condition causes a relatively dim output of light from lamp 120 and a relatively low rate of power consumption by lamp 120. Conversely, when dimming control signal 160 (node 159) is relatively high (e.g. FIG. 5A), then the peak amplitude of AC plasma signal 138 is also relatively high. This condition corresponds to a relatively high intensity light output from lamp 120 and a relatively high rate of power consumption by lamp 120.

When lamp 120 is being dimmed from full power (i.e. dimming control signal 160 is reduced from its maximum level), the entire length of lamp 120 may dim first. The central region of lamp 120 then starts to dim faster than the ends of lamp 120. As dimming proceeds further, the central region of lamp 120 smoothly extinguishes (because there is no plasma located in this central region), leaving two light-emission regions of light extending from electrodes $R_1$, $R_2$, towards the center of lamp 120. These light-emission regions may correspond to the regions of lamp 120 in which plasma is located. These regions in which plasma is located are influenced by the power level and frequency of plasma signal 138 which in turn contribute to electron confinement, as discussed above. These light-emission regions smoothly shrink as dimming control signal 160 is further reduced to provide additional dimming. As discussed above, the relatively high frequency of AC plasma signal 138 allows for controllable dimming ratios of over 1000:1.

Figure 4:
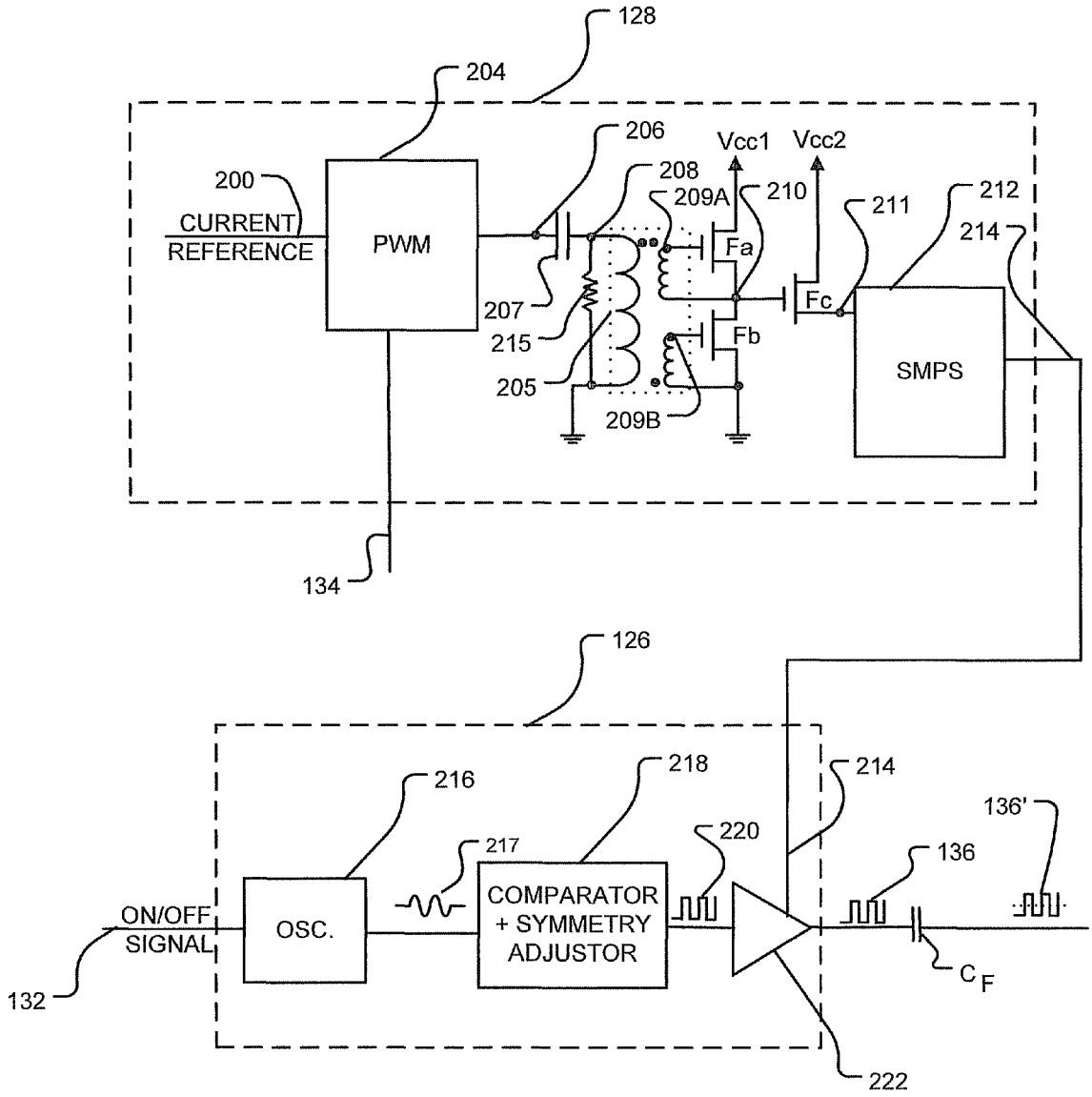
FIG. 4 is a schematic diagram of an exemplary filament signal power controller and an exemplary filament signal power supply that are suitable for use in the FIG. 2 system.

FIG. 4 schematically depicts one possible embodiment of filament signal power supply 126 and optional filament signal power controller 128 suitable for use with system 110 of FIG. 2. Filament signal power supply 126 receives ON/OFF signal 132 (e.g. from a user, an automated process or the like). In the FIG. 4 embodiment, filament signal power supply 126 also receives filament current control signal 214 from filament signal power controller 128. In other embodiments, filament signal power controller 128 and filament current control signal 214 are not necessary.

Upon receipt of ON/OFF signal 132, oscillator 216 outputs an oscillating signal 217 (i.e. without waiting for the preheat delay period Δ associated with plasma signal power supply 124). In the illustrated embodiment, oscillating signal 217 output by oscillator 216 has the same frequency as AC filament signal 136. Oscillating signal 217 may be provided to optional comparator/symmetry adjustor 218. Comparator/symmetry adjustor 218 may improve the symmetry of oscillating signal 217 to provide a symmetric square wave signal 220. Square wave signal 220 output by optional comparator/symmetry adjustor 218 may range between 0V and some amplitude level. Square wave signal 220 may be a 0V-5V square wave signal for example.

Square wave signal 220 output by comparator/symmetry adjustor 218 is provided to amplifier 222, which amplifies square wave signal 220 to produce amplified square wave signal (filament signal) 136. In some embodiments, comparator/symmetry adjustor 218 is not required. In such embodiments, oscillator 216 may be capable of directly producing an oscillating signal 217 that is sufficiently symmetrical for use in heating filaments $R_{1A}$, $R_{2A}$ of fluorescent lamp 120. In such embodiments, oscillating signal 217 may be provided directly to amplifier 222 and amplifier 222 may amplify oscillating signal 217 to produce filament signal 136. In other embodiments, alternative forms of square wave generators may be used in place of oscillator 216 and comparator/symmetry adjustor 218 to generate a substantially square wave signal 220.

In the illustrated embodiment, amplifier 222 receives filament current control signal 214 from optional filament signal power controller 128. Filament current control signal 214 controls amplifier 222 in such a manner as to control the amplitude of amplified square wave signal 136. By way of non-limiting example, filament current control signal 214 may provide a DC voltage level that is used as the upper rail of amplifier 222. In such embodiments, amplified square wave signal 136 may comprise a square wave signal that varies between 0V and an amplitude determined by the DC voltage level of filament current control signal 214. In some embodiments, the DC voltage level of filament current control signal 214 may vary between 0V-24V (depending on filament signal power controller 128), in which case the amplitude of amplified square wave signal 136 may also vary between 0V-24V. In other embodiments, filament signal power controller 128 is not required and amplified square wave signals 136 provided by amplifier 222 may have a predetermined amplitude.

Amplified square wave signal 136 is filtered by capacitor $C_F$ to remove the DC components from amplified square wave signal 136 and to thereby provide AC filament signal 136' to transformer $T_1$ as discussed above. As discussed above, AC filament signal 136' may vary above and below 0V. In the illustrated embodiment, the peak to peak amplitude of AC filament signal 136' is determined by the DC level of filament current control signal 214. AC filament signal 136' provides the preheat current to filaments $R_{1A}$, $R_{2A}$ of fluorescent lamp 120 (as discussed above).

A particular embodiment of optional filament signal power controller 128 is also shown in FIG. 4. In the illustrated embodiment, filament signal power controller 128 receives (or otherwise has access to) a desired current reference 200. Current reference 200 is provided as an input to a pulse width modulation (PWM) circuit 204. Preferably, current reference 200 is indicative of a desired current through filaments $R_{1A}$, $R_{2A}$ (or a desired temperature of filaments $R_1$, $R_2$), which will permit filaments $R_{1A}$, $R_{2A}$ to thermionically emit electrons, but which will substantially prevent evaporation of thermionic emission material from filaments $R_{1A}$, $R_{2A}$. Current reference 200 may be an internal parameter of system 110 and may be determined on the basis of the particular characteristics of lamp 120 and/or filaments $R_{1A}$, $R_{2A}$.

PWM circuit 204 also receives an optional filament current feedback signal 134. Filament current feedback signal 134 may be related to the temperature of one or both of filaments $R_{1A}$, $R_{2A}$. In one particular embodiment, filament current feedback signal 134 comprises an indication of a sensed value of the total current input into one or both of filaments $R_{1A}$, $R_{2A}$ (i.e. the total current produced in one of filaments $R_{1A}$, $R_{2A}$ resulting from AC plasma signal 138 and AC filament signal 136—see FIG. 2). In the FIG. 2 embodiment, the total current input into filament $R_{1A}$ creates a proportional voltage drop over sensor resistor $R_s$ and filament current feedback signal 134 comprises a voltage signal measured across the terminals of sensor resistor $R_s$.

In response to desired current reference signal 200 and feedback signal 134, PWM circuit 204 outputs a square wave AC signal (node 206) having a variable duty cycle which may depend on the difference between feedback signal 134 and current reference signal 200. The variable duty cycle of the PWM signal at node 206 may cause the total current in filaments $R_{1A}$, $R_{2A}$ (as sensed by feedback signal 134) to track desired current reference signal 200. In particular embodiments, the duty cycle of the node 206 PWM signal may be positively correlated with the difference between current reference 200 and feedback signal 134.

Figure 6A:
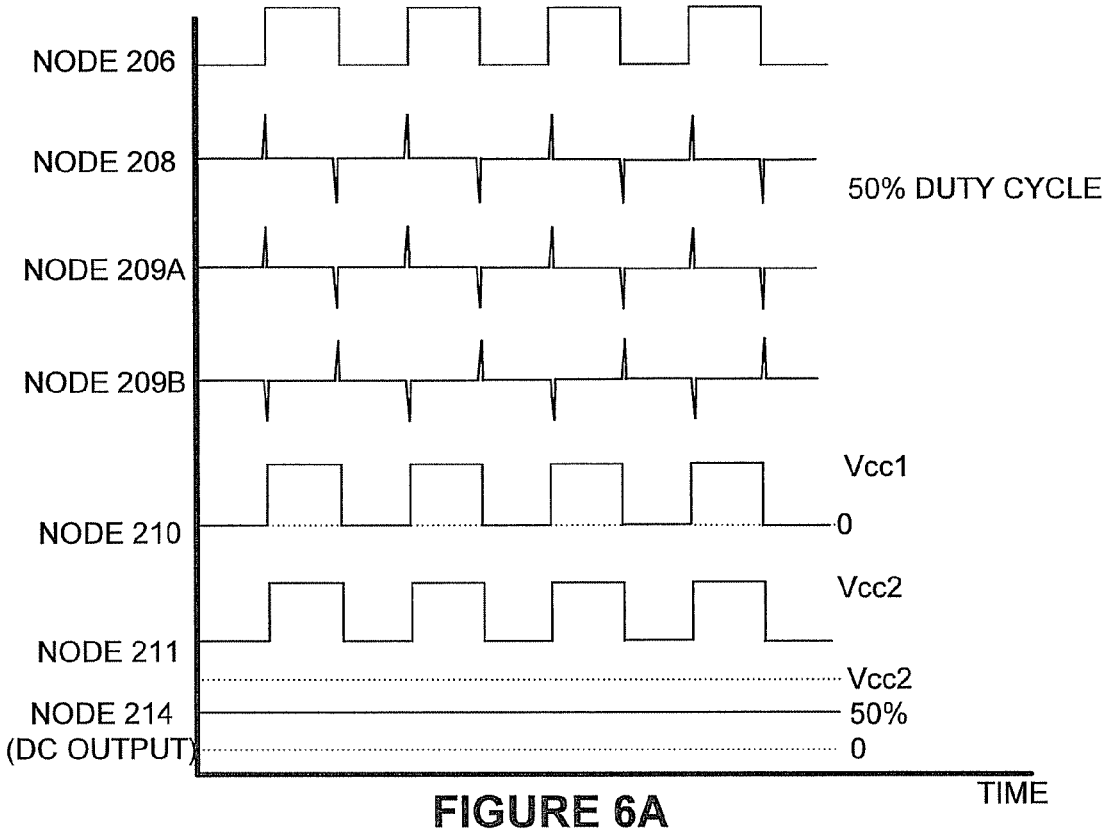
FIGS. 6A, 6B and 6C are schematic diagrams of sample waveforms at various nodes in the filament signal power controller of FIG. 4.
Figure 6B:
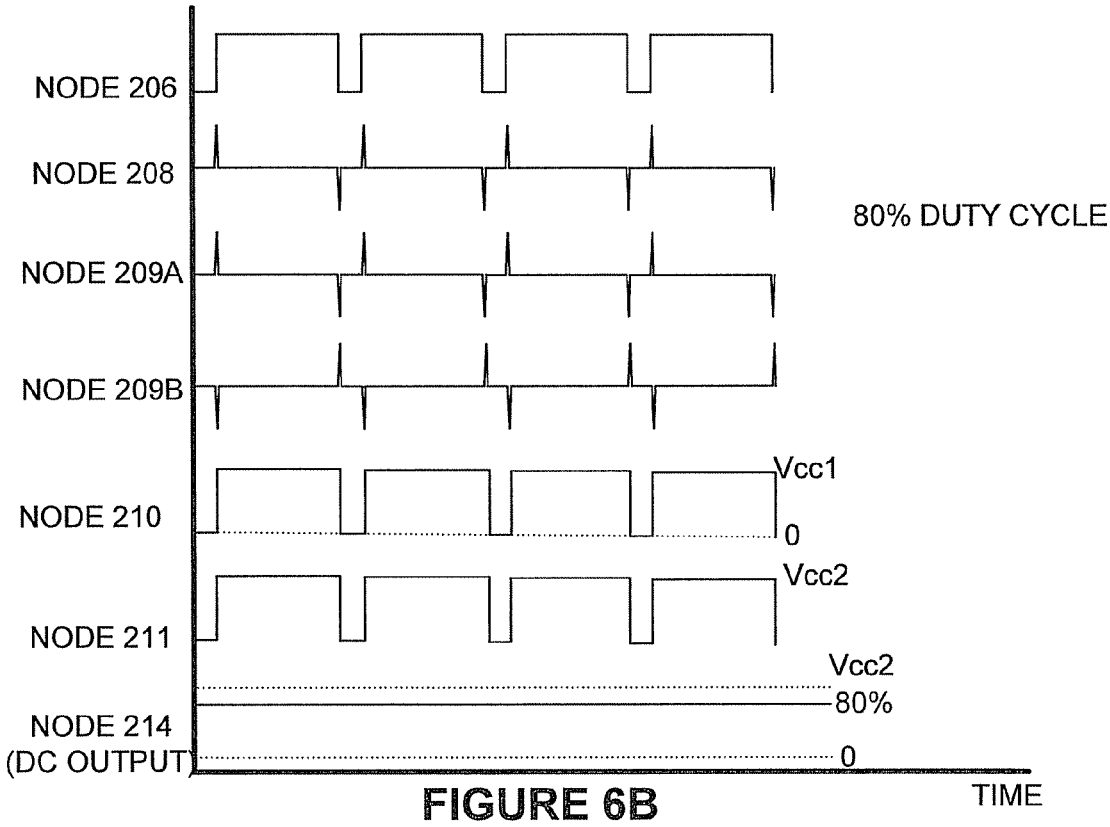
Figure 6C:
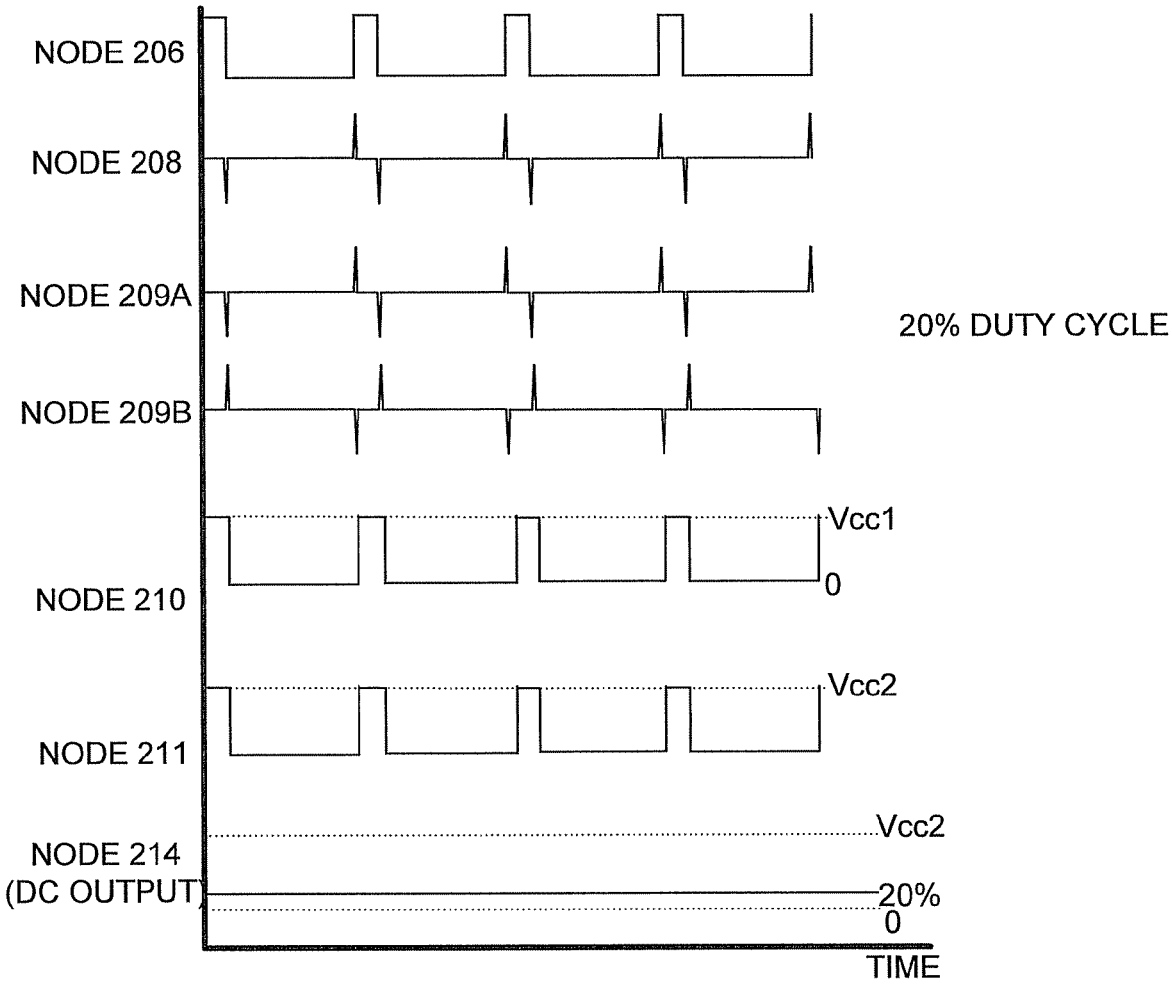

FIGS. 6A, 6B and 6C respectively schematically depict waveforms at various nodes of filament signal power controller 128 for PWM (node 206) duty cycles of 50%, 80% and 20%. Capacitor 207 acts as a differentiator which differentiates the node 206 PWM signal to generate a differentiated signal at node 208. The differentiation effect of capacitor 207 may be damped to some degree by resistor 215. FIGS. 6A, 6B and 6C schematically exhibit the node 208 signals for duty cycles of 50%, 80% and 20% respectively. The node 208 signal is received on the primary winding of transformer 205. Transformer 205 is a single input-dual output transformer having a first primary winding and a pair of opposing polarity secondary windings. Transformer 205 transfers the node 208 signal from its primary winding to its secondary windings. Because of the opposing polarity of the secondary windings of transformer 205, the node 208 signal on the primary winding creates opposing signals on the secondary windings (nodes 209A, 209B). The signals at nodes 209A, 209B of the secondary windings of transformer 205 are schematically shown in FIGS. 6A, 6B and 6C for duty cycles of 50%, 80% and 20% respectively.

When node 209A exhibits a positive spike (and node 209B exhibits a negative spike), transistor $F_a$ is turned on briefly, pulling the voltage at node 210 up to $V_{cc1}$. $V_{cc1}$ may be selected to be slightly higher than the maximum peak voltage of AC filament signal 136. In one particular embodiment, the maximum peak voltage of AC filament signal 136 is 24 V and $V_{cc1}$ is selected to be in a range of 24-30 V. When the positive spike at node 209A has passed, transistor $F_a$ turns off. However, even after transistor $F_a$ turns off, the voltage at node 210 will tend to remain at $V_{cc1}$ (in the absence of some other event), because the gate of transistor $F_c$ acts as a capacitor and there is no appreciable current flow into or out of the gate of transistor $F_c$. Under these conditions (i.e. when the voltage at node 210 is at or near $V_{cc1}$ and the gate of transistor $F_c$ is positively charged), transistor $F_c$ turns on, pulling node 211 up to $V_{cc2}$ and acting as a current source for switch mode power supply (SMPS) 212. Preferably, $V_{cc2}$ is set to be approximately equal to the maximum peak voltage of AC filament signal 136. In one particular embodiment, the maximum peak voltage of AC filament signal 136 and $V_{cc2}$ are selected to be 24 V, although other peak voltages are possible.

When node 209A exhibits a negative spike (and node 209B has a positive spike), transistor $F_b$ is turned on briefly, pulling the voltage at node 210 (i.e the gate of transistor $F_c$) down to near ground. When the positive spike at node 209B has passed, transistor $F_b$ turns off. However, even after transistor $F_b$ turns off, the voltage at node 210 will tend to remain at or near ground (in the absence of some other event), because there is no appreciable current flow into or out of the gate of transistor $F_c$. Under these conditions (i.e. when the voltage at node 210 is at or near the ground), transistor $F_c$ turns off, cutting off current flow to SMPS 212. When current flow to SMPS 212 is cut off, node 211 may float at some voltage level which may be determined by the internal circuitry of SMPS 212.

The signals at nodes 210 and 211 are schematically illustrated in FIGS. 6A, 6B and 6C for duty cycles of 50%, 80% and 20% respectively. It can be seen from FIG. 4 and FIGS. 6A, 6B and 6C that transistor $F_c$ acts as a switching input current source for SMPS 212. The duty cycle of the switching current flow from transistor $F_c$ is controlled by the duty cycle of the PWM signal (node 206), which in turn is controlled by the difference between current feedback signal 134 and current reference 200. In other embodiments, other circuits can be used to provide a current source between PWM 204 and SMPS 212.

SMPS 212 may be of any suitable architecture known to those skilled in the art. SMPS comprises a filter circuit (not explicitly shown) which outputs a DC voltage signal 214 related to the duty cycle of the output (node 206) of PWM 204. In some embodiments, this filter circuit may involve integration of the switching current (node 211) input from transistor $F_c$. Amplifiers (not explicit shown) may be used to buffer DC voltage output 214. In some embodiments, SMPS 212 comprises internal amplifiers. The DC voltage level of output 214 is determined by the switching current input from transistor $F_c$, which in turn is determined by the duty cycle of PWM signal (node 206) and the difference between current feedback signal 134 and current reference 200 as discussed above. As shown in FIG. 6A, when the PWM signal (node 206) is at 50%, then the DC voltage level of output 214 will be approximately 50% of $V_{cc2}$. Similarly in FIGS. 6B and 6C, when PWM signal (node 206) is at 80% and 20%, then the DC voltage level of output 214 will be approximately 80% and 20% of $V_{cc2}$.

During the preheat phase, only AC filament signal 136 produced by filament power supply 126 is providing current to filaments $R_{1A}$, $R_{2A}$. However, once plasma signal power supply 124 is activated and a plasma current is established in lamp 120 (i.e. after the preheat delay period Δ), AC plasma signal 138 produced by plasma signal power supply 124 will also contribute to the current flow through filaments $R_{1A}$, $R_{2A}$. Accordingly, although not expressly shown in the illustrated embodiments, filament current feedback signal 134 can be used to reduce the amplitude of AC plasma signal 138 after the preheat phase to minimize evaporation of thermionic emission material from filaments $R_{1A}$, $R_{2A}$ during operation of system 110.

FIGS. 8A-8D respectively depict the confinement regions 181A, 181B (collectively, confinement regions 181) and light-emission region(s) 185A, 185B (collectively, light-emission regions 185) for lamp 120 at various dimming levels—i.e. various levels of dimming signal 130 and dimming control signal 160. In the illustrated embodiments, FIGS. 8A, 8B, 8C and 8D respectively depict dimming levels DIM=a, DIM=b, DIM=c, DIM=d where a<b<c<d. As discussed above, the plasma frequency (i.e. the frequency of plasma signal 138) is selected to be above a dimming frequency threshold, such that electrons are generally confined to confinement regions 181 within lamp 120 and such confinement regions 181 vary with the dimming level. Confinement regions 181, which may be defined to be the expected value of the distance that an electron would travel in a half period of plasma signal 138, may be estimated for specific electron energy levels and for specific plasma frequencies using equations (1) and (2) discussed above.

Figure 8A:
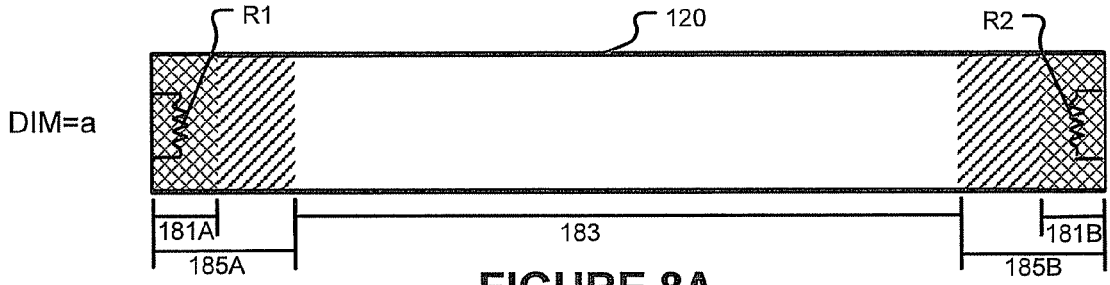
FIGS. 8A-8D respectively depict the confinement regions and light-emission region(s) for a lamp of the FIG. 2 fluorescent light system.
Figure 8B:
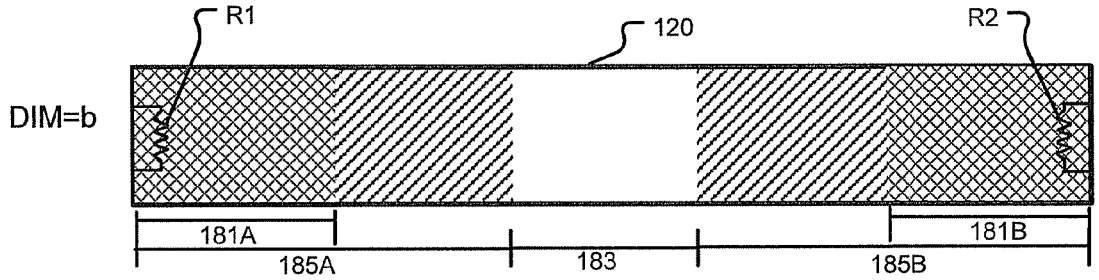

At the relatively low dimming level (DIM=a) depicted in FIG. 8A, electrons are respectively generally confined to confinement regions 181A, 181B which are relatively close to electrodes $R_1$, $R_2$ at the respective ends of lamp 120. Under such conditions, electrons in the plasma are repelled from the negative electrode (cathode) into the plasma for one half period of plasma signal 138 and are attracted back out of the plasma towards the positive electrode (anode) during the opposing half period and are generating ionized plasma in the lamp in the process. At the dimming level (DIM=a) of FIG. 8A, the light-emission regions 185A, 185B of lamp 120 are larger than their respective confinement regions 181A and 181B. Light emission regions 185 correspond generally to the regions of lamp 120 in which plasma is located. Plasma generation may be confined to confinement regions 181A, 181B. Once generated, however, plasma may tend to expand farther into the lamp because of its net positive charge. The net positive plasma charge develops when relatively mobile electrons, repelling each other, expand out of the plasma toward the lamp walls. Some electrons may end up stuck to the lamp walls, leaving an excess of positive ions in the plasma to repel each other and to thereby expand the plasma outside of the confinement regions 181A, 181B. At the dimming level (DIM=a) of FIG. 8A, it can be observed that the light emitted in confinement regions 181A, 181B is brighter than the light emitted in the remainder of light-emission regions 185A, 185B. Substantially no light is emitted in central region 183 between light-emission regions 181A, 181B. At the next highest dimming level (DIM=b) depicted in FIG. 8B, electrons are provided with relatively higher energy. Consequently, confinement regions 181A, 181B and light-emission regions 185A, 185B extend further toward the center of lamp 120 and central, non-light-emission region 183 is correspondingly smaller. It can be seen by comparing FIGS. 8A and 8B that with increasing dimming level, light-emission regions 185 grow faster than confinement regions 181.

Figure 8C:
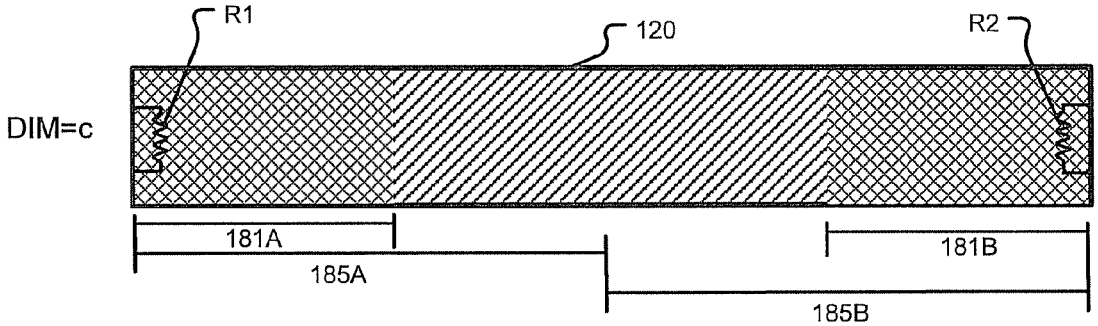
Figure 8D:
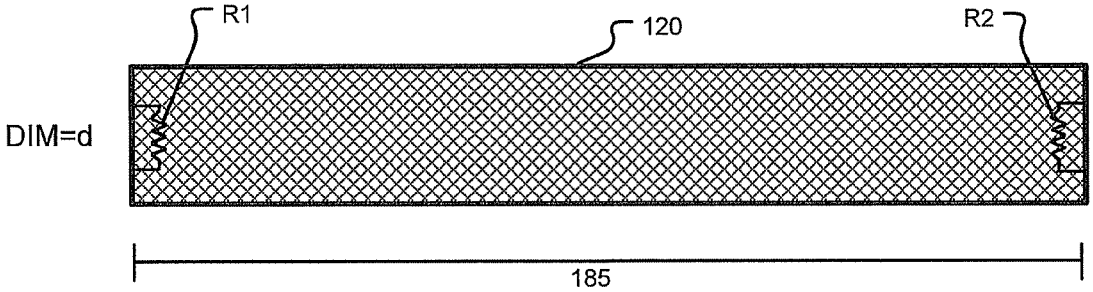

In FIG. 8C, where the dimming level (DIM=c) is larger, light-emission regions 185A, 185B extend exactly to the middle of lamp 120 such that light is emitted over substantially the entire length of lamp 120 between electrodes $R_1$ and $R_2$. Consequently, at this dimming level (DIM=c), there is no longer any central non-light-emission region 183. At the dimming level (DIM=c) of FIG. 8C, it can still be observed that the light emitted in confinement regions 181A, 181B is brighter than the light emitted in the rest of light-emission regions 185A, 185B. In FIG. 8D, where the dimming level (DIM=d) is still larger, light-emission region 185 extends over the entire distance between electrodes $R_1$, $R_2$. While there is no change in the size of the light emission region between the dimming levels DIM=c (FIG. 8C) and DIM=d (FIG. 8D), the light emitted at the higher dimming level (DIM=d) is brighter than that of the lower dimming level (DIM=c). In addition, at the dimming level (DIM=d) of FIG. 8D, it is more difficult to observe the difference in brightness between the confinement regions and the remainder of the light-emission region.

Figure 7:
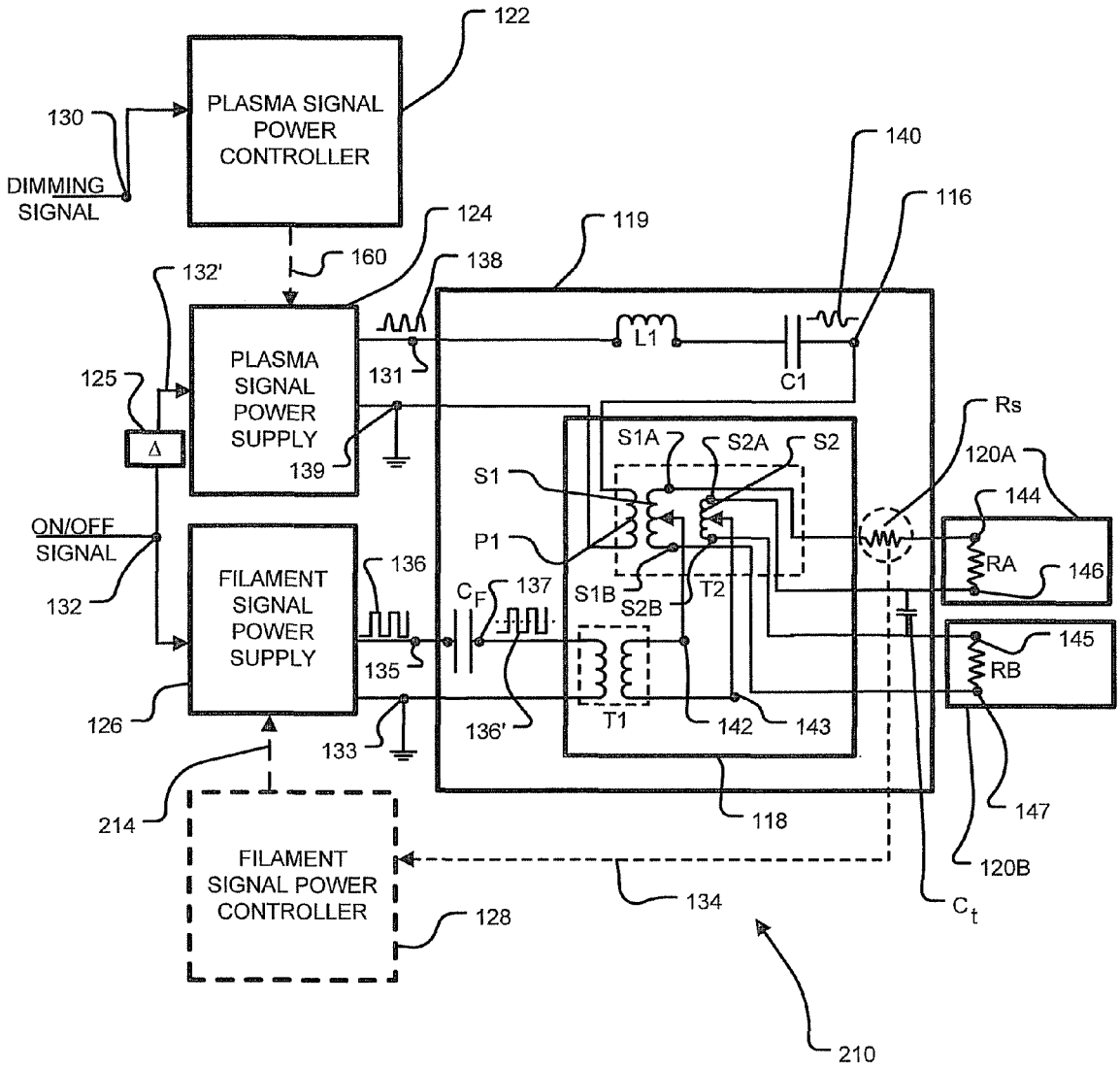
FIG. 7 is a schematic diagram of a fluorescent light system according to another particular embodiment of the invention.

FIG. 7 depicts a fluorescent light system 210 according to another particular embodiment of the invention. Fluorescent light system 210 is substantially similar to light system 110 (FIG. 2) in many respects and similar components are provided with similar reference numbers. Fluorescent light system 210 differs from system 110 described above primarily in that rather than having a single lamp 120 with a pair of electrodes $R_1$, $R_2$, light system 210 comprises a pair of lamps 120A, 120B and each of lamps 120A, 120B respectively comprises a single electrode $R_A$, $R_B$. Plasma current introduced by plasma signal power supply 124 and plasma signal 138 flows between each of the single electrodes $R_A$, $R_B$ and ionized gas surrounding the respective electrodes.

Providing a pair of lamps 120A, 120B with a single control system (system 120) wherein each lamp has a single electrode $R_A$, $R_B$ may provide several notable advantages over the prior art. By way of non-limiting example, typical fluorescent light systems must provide wire at each end of their lamps, to provide power to each of the electrodes within the lamp. Accordingly, there is a wire savings when it is only necessary to provide wire to a single side of a lamp (i.e. to a single electrode). For the same reasons, light installation time may be saved when installing new light systems and when retrofitting new lights into old structures or the like. Additionally, there is considerable manufacturing cost associated with placing electrodes within fluorescent lamps. Manufacturing lamps with single electrodes may help to reduce some of these costs.

FIGS. 9A-9D respectively depict the confinement regions 181A, 181B (collectively, confinement regions 181) and light-emission region(s) 185A, 185B (collectively, light-emission regions 185) for lamps 120A, 120B of fluorescent light system 210 at various dimming levels—i.e. various levels of dimming signal 130 and dimming control signal 160. In the illustrated embodiments, FIGS. 9A, 9B, 9C and 9D respectively depict dimming levels DIM=a, DIM=b, DIM=c, DIM=d where a<b<c<d. As discussed above, the plasma frequency (i.e. the frequency of plasma signal 138) is selected to be above a dimming frequency threshold, such that electrons are generally confined to confinement regions 181A, 181B within lamps 120A, 120B and such confinement regions 181A, 181B vary with the dimming level.

Figure 9A:
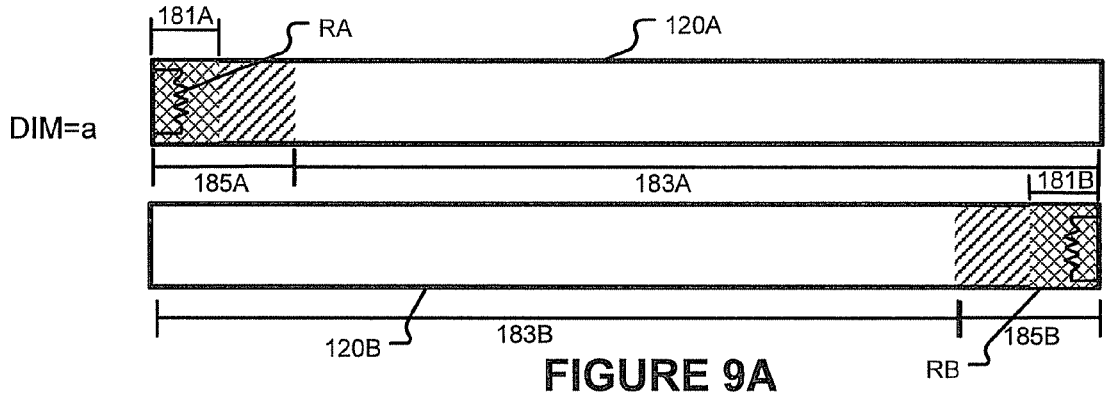
FIGS. 9A-9D respectively depict the confinement regions and light-emission region(s) for the lamps of the FIG. 7 fluorescent light system.
Figure 9B:
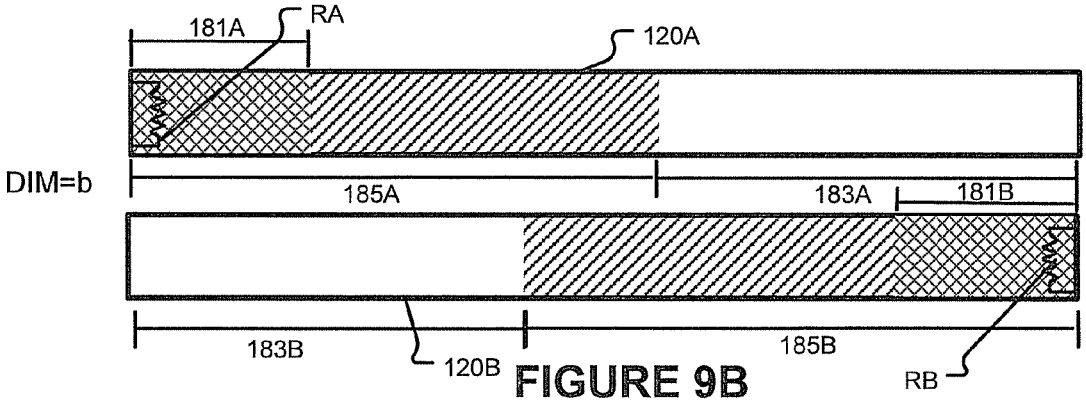

At the relatively low dimming level (DIM=a) depicted in FIG. 9A, electrons in lamps 120A, 120B are respectively generally confined to confinement regions 181A, 181B which are relatively close to their respective electrodes $R_A$, $R_B$. Under such conditions, electrons in the plasma of each lamp 120A, 120B are repelled from the negative electrode (cathode) into the plasma for one half period of plasma signal 138 and are attracted back out of the plasma towards the positive electrode (anode) during the opposing half period and are generating ionized plasma in the lamp in the process. At the dimming level (DIM=a) of FIG. 9A, the light-emission regions 185A, 185B of lamps 120A, 120B are larger than their respective confinement regions 181A and 181B. Light emission regions 185 correspond generally to the regions of lamp 120 in which plasma is located. At the dimming level (DIM=a) of FIG. 9A, it can be observed that the light emitted in confinement regions 181A, 181B is brighter than the light emitted in the remainder of light-emission regions 185A, 185B. Substantially no light is emitted in distal regions 183A, 183B between light-emission regions 185A, 185B and the distal ends of lamps 120A, 120B (i.e. the ends of lamps 120A, 120B away from electrodes $R_A$, $R_B$). At the next highest dimming level (DIM=b) depicted in FIG. 9B, electrons are provided with relatively higher energy. Consequently, confinement regions 181A, 181B and light-emission regions 185A, 185B extend further toward the distal ends of lamps 120A, 120B and non-light-emission regions 183A, 183B are correspondingly smaller. It can be seen by comparing FIGS. 9A and 9B that with increasing dimming level, light-emission regions 185 grow faster than confinement regions 181.

Figure 9C:
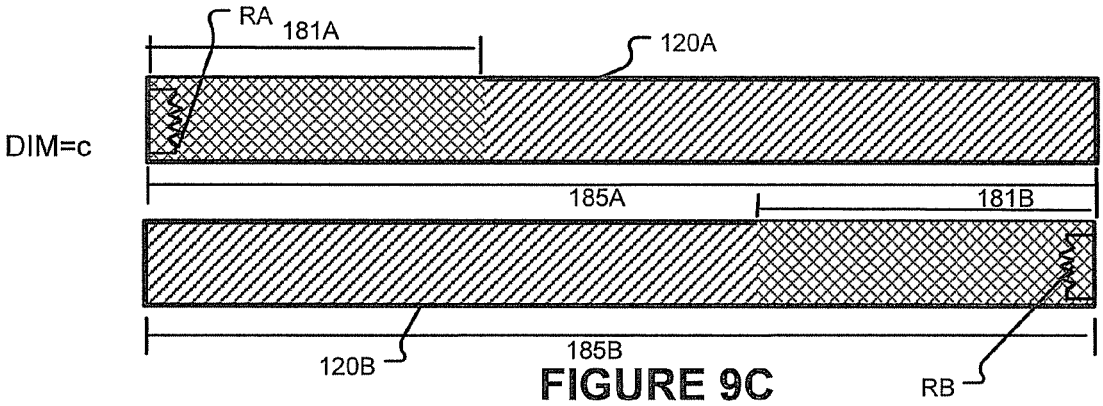
Figure 9D:
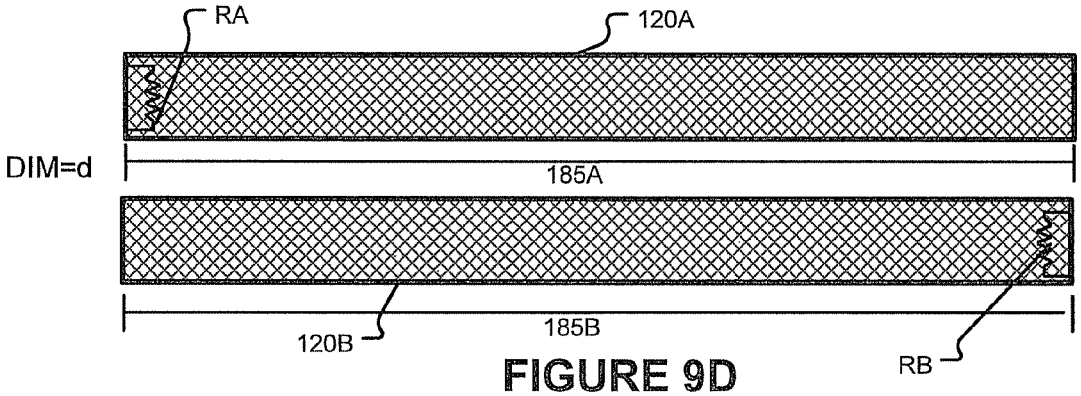

In FIG. 9C, where the dimming level (DIM=c) is larger, light-emission regions 185A, 185B extend all the way to the distal ends of lamps 120A, 120B. At this dimming level (DIM=c), there are no longer any non-light-emission regions 183. At the dimming level (DIM=c) of FIG. 9C, it can still be observed that the light emitted in confinement regions 181A, 181B is brighter than the light emitted in the rest of light-emission regions 185A, 185B. In FIG. 9D, where the dimming level (DIM=d) is still larger, the sizes of the light emission regions 185A, 185B do not change, but the light emitted at the higher dimming level (DIM=d) is brighter than that of the lower dimming level (DIM=c). In addition, at the dimming level (DIM=d) of FIG. 9D, it is more difficult to observe the difference in brightness between the confinement regions and the remainder of the light-emission regions.

Figure 10:
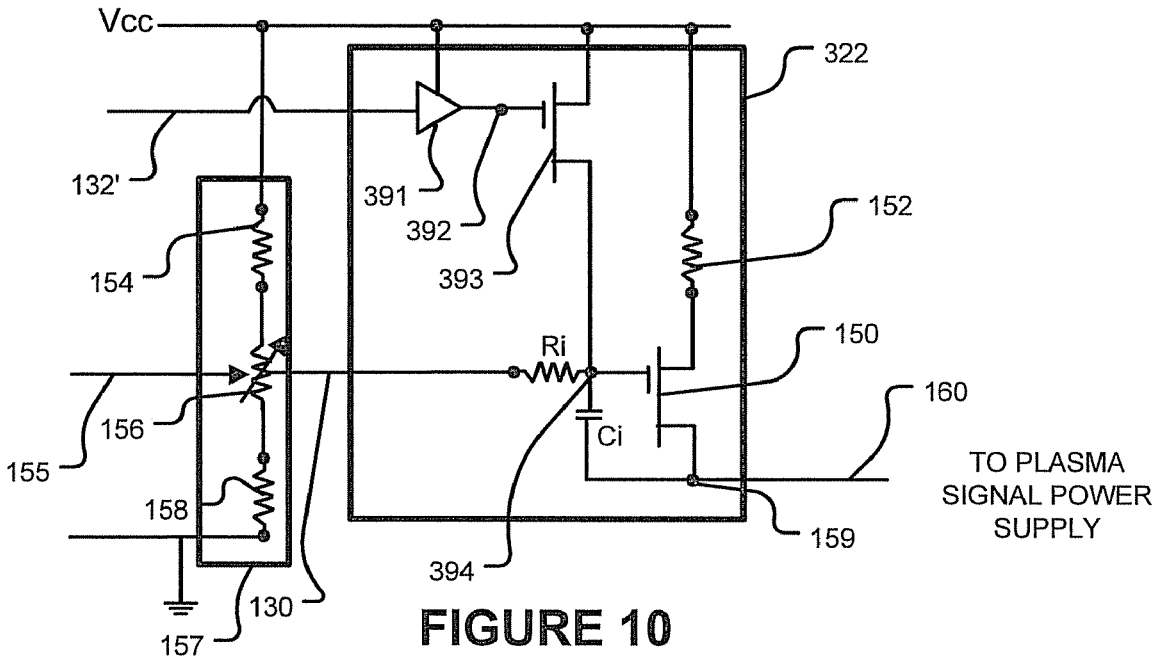
FIG. 10 is a schematic drawing of a plasma signal power controller according to another embodiment of the invention which may be used in place of the plasma signal power controller of FIG. 3.

FIG. 10 is a schematic depiction of an plasma signal power controller 322 according to another embodiment of the invention. Plasma signal power controller 322 may be used in the place of plasma signal power supply 122 described above, for example. In many respects, plasma signal power controller 322 is similar to plasma signal power controller 122 described above and similar reference numerals are used to refer to similar components. The principal difference between plasma signal power controller 322 and plasma signal power controller 122 is that plasma signal power controller 322 incorporates a number of additional circuit components which allow the amplitude of plasma signal 138 to ramp upwardly gradually and smoothly to the level determined by dimming signal 130.

In the illustrated embodiment of FIG. 10, dimming signal 130 is obtained from dimming input 155 using a voltage divider circuit 157 in a manner similar to that depicted in FIG. 3 and described above. In other embodiments, other circuits (digital or analog) could be used to generate a dimming signal 130 representative of input 155. Dimming signal 130 is provided to plasma signal power controller 322. In the illustrated embodiment of FIG. 10, plasma signal power controller 322 also receives delayed ON/OFF signal 132' which varies between ground (when delayed ON/OFF signal 132' is OFF) and some positive voltage (when delayed ON/OFF signal 132' is ON). In the illustrated embodiment, amplifier 391 amplifies delayed ON/OFF signal 132' to the level of $V_{cc}$. Thus, when ON/OFF signal 132 is turned ON by a user, an automated process or the like, node 392 remains at ground potential for the delay period Δ and then steps up to the level of $V_{cc}$ after the delay period Δ.

The signal on node 392 is received at the gate of p-channel transistor 393. When node 392 is low (e.g. at ground in the illustrated embodiment), then p-channel transistor 393 turns on and pulls node 394 up to $V_{cc}$. Since node 394 is the gate of p-channel transistor 150, transistor 150 turns off and is prevented from conducting current. As discussed above, when transistor 150 is off and non-conducting, no current is provided to dimming control signal 160 on node 159 (i.e. no current is available on dimming control signal 160 for plasma signal power supply 124).

When the signal on node 392 is high (e.g. at $V_{cc}$ in the illustrated embodiment), then p-channel transistor 393 turns off and does not conduct. Thus, transistor 150 is free to turn on under the influence of dimming signal 130. Plasma signal power supply 322 also incorporates a resistor $R_i$ and capacitor $C_i$ which form an integrator between dimming signal 130 and node 394 at the gate of transistor 150. When delayed ON/OFF signal 132' and node 392 transition from low to high, transistor 393 turns off and, rather than transitioning immediately (or at least in the relatively fast transition of an ON/OFF step function) to the level of dimming signal 130 (as is the case in plasma signal power controller 122 of FIG. 3), resistor $R_i$ and capacitor $C_i$ cause the voltage at node 394 to change gradually (e.g. to ramp upwardly) to a level determined by dimming signal 130 and input 155. When the level of node 394 is sufficiently low, transistor 150 turns on and supplies current to node 159 and to dimming control signal 160 which in turn supplies current to plasma signal power supply 124. Because resistor $R_i$ and capacitor $C_i$ cause node 394 to ramp gradually to the voltage level determined by dimming signal 130, transistor 150 is turned on gradually and the current supplied to plasma signal power supply 122 on dimming control signal 160 is supplied gradually (i.e. in the form of a ramp) rather than instantaneously (i.e. in the form of a step function). Consequently, the power of plasma signal 138 generated by plasma signal power supply 122 also ramps up gradually to the level determined by dimming signal 130. The ramping of the power of plasma signal 138 is preferably smooth. The ramping of the power of plasma signal 138 may be, but need not be, linear. In some embodiments, ramping of the power of plasma signal 138 may be exponential. The ramping of the power of plasma signal 138 is preferably gradual. In some embodiments, the ramping of the power of plasma signal 138 takes over 0.1 seconds. In other embodiments, the ramping of the power of plasma signal 138 takes over 0.2 seconds.

Resistor $R_i$ and capacitor $C_i$ may be selected to provide desirable delay (e.g. desirable ramping and/or integration characteristics). An advantage of ramping dimming control signal 160 current (and the corresponding level of plasma signal 138) is that the arc current supplied to the lamp is also ramped up, so that the lamp turns on smoothly and gradually, thereby avoiding excessive spikes or rapid changes in plasma current and correspondingly reducing stress on, and prolonging the useful life of, electrodes, filaments and other lamp components. When a conventional ballast is starting a fluorescent lamp, ionization of the gas proceeds from the electrodes into the gas until the two ionized columns meet, initiating conduction through the lamp. During this period, very high voltages (hundreds of volts) and currents appear on the electrodes which may cause excessive spikes or rapid changes in plasma current and consequential lamp damage. It is not possible to effectively ramp conventional lamps slowly because they cannot be started at low voltages and currents. Ballasts according to particular embodiments described herein start near 35 volts and at very low current—i.e. initial power can be a few milliwatts. If, starting from zero, the power is gradually increased, at such a rate that it reaches full power in 250 milliseconds, lamp damage will be almost eliminated, the current and voltage stresses having remained far below the damage thresholds. This means that bringing the power up from zero to anywhere up to full power will cause minimal damage or wear. The lamps will go for years with no loss of efficiency.

The ballasts described herein are capable of being fabricated on a single, inexpensive integrated circuit, without the need for expensive parts. Electronics which work according to the embodiments described above have been experimentally shown to be over 90% efficient and this efficiency may be maintained over a relatively long lifetime as lamp damage due to sputtering and the corresponding efficiency losses may be minimized or otherwise substantially eliminated. Ballasts according to the embodiments described herein have been experimentally used to provide over 1,000,000 lamp starts with no significant lamp damage.

Experiment

The inventor has conducted an experiment on an OSRAM 22 W circular T5 fluorescent lamp at a plasma signal frequency (i.e. of AC plasma signal 138) of 2.5 MHz. Using these operating conditions, the lamp provided dimming operation over a relatively large dimming range (e.g. over 1800:1 dimming range in typical embodiments as compared to 100:1 dimming range characteristic of prior art dimming lamps). This dimming range corresponds to a high end lamp output of 22 W (i.e. the rated output level of the lamp) and a low end lamp output of 12 mW.

At the low dimming level of about 12 mW, the electron velocity in a fluorescent lamp plasma may be calculated according to equations (1) and (2) to be approximately ~50 km/s. As discussed above, electrons in the plasma are repelled from the negative electrode (cathode) into the plasma for one half cycle and attracted back out of the plasma towards the positive electrode (anode) during the opposing half cycle. For a plasma signal frequency of 2.5 MHz, each half cycle is approximately ~200 ns. Accordingly, the expected value of the distance traveled by such electrons in a half period of the plasma signal (i.e. the confinement region) is approximately 1 cm—i.e. in a 200 ns cycle, electrons travel approximately 1 cm into the plasma and 1 cm back, interacting with atoms to form a glowing plasma (i.e. a light-emission region) which extends approximately ~1 cm into the plasma from each electrode.

Increasing the dimming level from ~12 mW causes the velocity of the electrons to increase and therefore the light-emission region of the plasma extends further from each electrode toward the center of the lamp (~63 cm long). At a dimming level of ~½ W, the light-emission regions extending from each electrode meet one another in the middle of the lamp. The lamp is then uniformly illuminated. As the power level increases further (i.e. toward the maximum rated power), the light output grows continuously brighter until full brightness is achieved at a dimming level of 22 W. When the lamp reached full power at 22 W, the electron velocity determined from equations (1) and (2) has increased by an factor of ~33 times to ~1640 km/s. At this velocity, the confinement region of the electrons is ~33 cm.

Even when the lamp is running at full power, the electron confinement region is less than the distance between the electrodes. This corresponds to a condition where plasma generation occurs only at the ends of the lamp (i.e. in the first 1 to 33 cm from the electrodes). Electrons do not flow through the lamp as they do in low frequency ballasts, rather electrons tend to oscillate back and forth in the ends of the lamp (i.e. between each electrode and its surrounding plasma) in a volume extending 33 cm or less from the electrode. The dimension of this confinement region depends on the dimming level.

The uv light that makes fluorescent lamp phosphors emit light is generated by mercury atoms which are excited by electrons. The electrons acquire 5.88 or 6.7 electron volts (ev) of energy which they transfer to the resonance lines in mercury atoms, where the energy is stored, and after a delay, re-emitted as 253.7 nm or 184.9 nm photons. An issue in prior art lamp operation, is that some $2\times10^{15}$ electrons are flowing through the lamp each second and these electrons tend to collide with mercury atoms which are about to emit resonance photons, causing those mercury atoms to emit the stored energy via a decay mode other than the desired high efficiency resonant decay scheme. From the light generation perspective, this energy is mostly lost. In the lamp described herein, at low dimming levels, plasma is created in the confinement regions at the ends of the lamp adjacent the electrodes and then, at higher dimming levels, the plasma expands into the central zone. Since the electron current is relatively low (and may be almost zero) in these central regions, UV emission efficiency in these central regions can be expected to improve in relation to prior art lamps.

The ballasts described herein operate with the filaments (thermionic emitters) fully heated whenever there is plasma current. Plasma signal power supply 124 is inhibited during initial warmup so that no ionization occurs in the gas of the lamp during the preheat period Δ. Once the thermionic filament emitters $R_{1A}$, $R_{2A}$ are functional, they are surrounded by a space charge of electrons. Positive ions attracted towards the filaments when they are acting as cathodes are neutralized when they reach the outer periphery of the space charge and any energy such positive ions might have acquired is dissipated before they get near the cathode. Sputtering, a major cause fluorescent lamp damage and failure is minimized or substantially eliminated.

As will be apparent to those skilled in the art in the light of the foregoing disclosure, many alterations and modifications are possible in the practice of this invention without departing from the spirit or scope thereof. For example:

- the power supplies and the power supply controllers described above make use of analog control methods. In alternative embodiments, digital controllers and/or digital components may be used to control the amplitude of the filament signal and the amplitude of the plasma signal;
- as discussed above, filament signal power controller 128 is optional. The above-described embodiment of filament signal power controller 128 (FIGS. 2 and 4) involves measuring a feedback signal 134 representative of the current through filament(s) $R_{1A}$ and/or $R_{2A}$ and using this feedback signal 134 together with a current reference signal 200 to control filament signal power supply 126 and the resultant filament current through filament(s) $R_{1A}$ and/or $R_{2A}$. In other embodiments, filament signal power supply 126 may be provided with its own current reference which may be tunable or otherwise configured such that filament signal power supply 126 outputs a filament signal 136 with a desired amplitude. In still other embodiments, filament signal power controller 128 can operate "open loop" (i.e. without feedback signal 134). For example, in some embodiments, filament signal power controller 128 can comprise a tunable current reference which may be amplified (if required) and used as filament power control signal 214. In other embodiments, filament signal power controller 128 can comprise a bi-modal controller, which outputs a filament power control signal 214 with a first (preheat) power level during the preheat period Δ and a second (operational) power level after the preheat period Δ. For example, the preheat level of filament power control signal 214 may be greater than the operational level of filament power control signal 214 such that filament signal 136 has a relatively high amplitude in the preheat period Δ and a relatively low amplitude after the preheat period Δ. This bi-modality may be used to maintain optimum heat level during the preheat period Δ and to reduce the amplitude of the filament signal 136 to compensate for the extra heat generated by the plasma current after the preheat period Δ. Such a bi-modal embodiment of filament signal power controller 128 may make use of ON/OFF signal 132 and/or delayed ON/OFF signal 132' to provide the logic for selecting the modality of filament power control signal 214.

Accordingly, the scope of the invention is to be construed in accordance with the substance defined by the following claims.

What is claimed is:

1. A system for operating a fluorescent light, the system comprising:

a fluorescent lamp comprising at least one electrode, the at least one electrode comprising at least one corresponding filament;

a filament signal power supply connected to output a filament signal and to create a corresponding filament current through the at least one filament, the filament current having a filament frequency; and a plasma signal power supply connected to output a plasma signal and to create a corresponding plasma current flowing between the at least one electrode and a gas contained in the lamp, the plasma current having a plasma frequency;

wherein the plasma frequency is greater than the filament frequency; and wherein the plasma signal power supply is configurable to control a power of the plasma current flowing between the at least one electrode and the gas such that the plasma current is confined to a confinement region extending from the at least one electrode, the confinement region having a length less than a length of the lamp.

2. A system according to claim 1 wherein the length of the confinement region is less than 50% of the length of the lamp.

3. A system according to claim 1 wherein the length of the confinement region is less than 25% of the length of the lamp.

4. A system according to claim 1 wherein the plasma frequency is 250 kHz or greater.

5. A system according to claim 1 wherein the plasma signal power supply is configurable to control the power of the plasma current to a first power range, such that for plasma current in the first power range, photons are emitted from a first light-emission region extending from the at least one electrode and having a length less than the length of the lamp and photons are not emitted from a first non-light-emission region at an opposing end of the lamp.

6. A system according to claim 5 wherein the length of the first light-emission region is less than 50% of the length of the lamp.

7. A system according to claim 5 wherein the length of the first light-emission region is less than 25% of the length of the lamp.

8. A system according to claim 5 wherein the plasma signal power supply is configured to control the power of the plasma current in response to a dimming input.

9. A system according to claim 5 wherein the plasma signal power supply is configurable to control the power of the plasma current to a second power range, such that for plasma current in the second power range, photons are emitted from substantially an entire length of the lamp.

10. A system according to claim 9 wherein a ratio of a maximum plasma current power for plasma current in the second power range to a minimum plasma current power for plasma current in the first power range is configurable to be 1000:1 or more.

11. A system for operating a fluorescent light, the system comprising:

a fluorescent lamp comprising at least one electrode, the at least one electrode comprising at least one corresponding filament;

a filament signal power supply connected to output a filament signal and to create a corresponding filament current through the at least one filament, the filament current having a filament frequency; and a plasma signal power supply connected to output a plasma signal and to create a corresponding plasma current flowing between the at least one electrode and a gas contained in the lamp, the plasma current having a plasma frequency;

wherein the plasma frequency is greater than the filament frequency; and wherein the lamp comprises a pair of electrodes at opposing ends of the lamp and the plasma signal power supply is configurable to control:

a power of a first plasma current flowing between a first electrode and the gas contained in the lamp such that the first plasma current is confined to a first confinement region extending from the first electrode into the gas;

a power of a second plasma current flowing between a second electrode and the gas contained in the lamp such that the second plasma current is confined to a second confinement region extending from the second electrode and into the gas;

wherein lengths of the first and second confinement regions are less than a distance between the first and second electrodes.

12. A system according to claim 11 wherein the lengths of the first and second confinement regions are less than 25% of the distance between the first and second electrodes.

13. A system according to claim 11 wherein the plasma frequency is 250 kHz or greater.

14. A system according to claim 11 wherein the plasma signal power supply is configurable to control the power of the first and second plasma currents to a first power range, such that for first and second plasma currents in the first power range, photons are emitted from a first light-emission region extending from the first electrode toward a center of the lamp and from a second light-emission regions extending from the second electrode toward the center of the lamp, the first and second light-emission regions spaced apart from one another by a central non-light-emission region from which photons are not emitted.

15. A system according to claim 14 wherein a length of the first light-emission region and a length of the second light-emission region are less than 25% of the distance between the first and second electrodes.

16. A system according to claim 14 wherein the plasma signal power supply is configured to control the power of the first and second plasma current in response to a dimming input.

17. A system according to claim 14 wherein the plasma signal power supply is configurable to control the power of the first and second plasma currents to a second power range, such that for first and second plasma currents in the second power range, photons are emitted from substantially the entire distance between the first and second electrodes.

18. A system according to claim 17 wherein a ratio of a maximum power of the first plasma current in the second power range to a minimum power of the first plasma current in the first power range is configurable to be 1000:1 or more.

19. A method for operating a fluorescent light, the method comprising:

providing a fluorescent lamp comprising at least one electrode, the at least one electrode having a corresponding filament;

generating a filament signal which creates a filament current through the at least one filament, the filament current having a filament frequency;

generating a plasma signal which creates a plasma current flowing between the at least one electrode and a gas contained in the fluorescent lamp, the plasma current having a plasma frequency greater than the filament frequency;

controlling a power of the plasma current at the plasma frequency such that the plasma current flowing between the at least one electrode and the gas is confined to a confinement region extending from the at least one electrode, the confinement region having a length less than a length of the lamp.

20. A system according to claim 19 wherein the plasma frequency is 250 kHz or greater.

21. A method according to claim 19 comprising controlling the power of the plasma current to a first power range, such that for plasma current in the first power range, photons are emitted from a first light-emission region extending from the at least one electrode and having a length less than the length of the lamp and photons are not emitted from a first non-light-emission region at an opposing end of the lamp.

22. A method according to claim 21 comprising controlling the power of the plasma current to a second power range, such that for plasma current in the second power range, photons are emitted from substantially an entire length of the lamp.

23. A method for operating a fluorescent light, the method comprising:

providing a fluorescent lamp comprising at least one electrode, the at least one electrode having a corresponding filament;

generating a filament signal which creates a filament current through the at least one filament, the filament current having a filament frequency;

generating a plasma signal which creates a plasma current flowing between the at least one electrode and a gas contained in the fluorescent lamp, the plasma current having a plasma frequency greater than the filament frequency;

wherein the lamp comprises a pair of electrodes at opposing ends of the lamp and wherein generating the plasma signal comprises:

controlling a power of a first plasma current flowing between a first electrode and the gas contained in the lamp such that the first plasma current is confined to a first confinement region extending from the first electrode into the gas;

controlling a power of a second plasma current flowing between a second electrode and the gas contained in the lamp such that the second plasma current is confined to a second confinement region extending from the second electrode and into the gas;

wherein lengths of the first and second confinement regions are less than a distance between the first and second electrodes.

24. A system according to claim 23 wherein the plasma frequency is 250 kHz or greater.

25. A method according to claim 23 comprising controlling the power of the first and second plasma currents to a first power range, such that for first and second plasma currents in the first power range, photons are emitted from a first light-emission region extending from the first electrode toward a center of the lamp and from a second light-emission regions extending from the second electrode toward the center of the lamp, the first and second light-emission regions spaced apart from one another by a central non-light-emission region from which photons are not emitted.

26. A method according to claim 25 comprising controlling the power of the first and second plasma currents to a second power range, such that for first and second plasma currents in the second power range, photons are emitted from substantially the entire distance between the first and second electrodes.

* * * * *